US011236557B2

(12) United States Patent
Upmeier et al.

(10) Patent No.: US 11,236,557 B2
(45) **Date of Patent: *Feb. 1, 2022**

(54) CORE TUBE HANDLING DEVICE

(71) Applicant: BLY IP INC., Salt Lake City, UT (US)

(72) Inventors: Thorsten Upmeier, Schlitz (DE); Christof Kruse, Wenden (DE); Trevor Zwar, Hallett Cove (AU)

(73) Assignee: BLY IP INC., Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/111,856

(22) Filed: Dec. 4, 2020

(65) Prior Publication Data

US 2021/0087894 A1 Mar. 25, 2021

Related U.S. Application Data

(63) Continuation of application No. 16/697,939, filed on Nov. 27, 2019, now Pat. No. 10,947,793.

(60) Provisional application No. 62/772,386, filed on Nov. 28, 2018.

(51) Int. Cl.
*E21B 19/15* (2006.01)
*E21B 19/06* (2006.01)

(52) U.S. Cl.
CPC ..... *E21B 19/155* (2013.01); *E21B 19/06* (2013.01)

(58) Field of Classification Search
CPC ..... E21B 19/155; E21B 19/06; E21B 25/005; E21B 25/02; E21B 19/20; E21B 19/14; E21B 19/087; E21B 19/15
See application file for complete search history.

(56) References Cited

U.S. PATENT DOCUMENTS 10,947,793 B2 * 3/2021 Upmeier ..... E21B 19/06

* cited by examiner

*Primary Examiner* — Gregory W Adams
(74) *Attorney, Agent, or Firm* — Ballard Spahr LLP

(57) ABSTRACT

A core tube handling device can be used with exploratory drilling rigs. The device can include a slew arm mounted on the rig's mast and a pivot arm mounted on the slew arm. When the slew arm is adjacent to the mast, clamping devices on the pivot arm can grasp and hold a core tube from the drill string. The slew arm can pivot away from the mast and align the pivot arm with a tray that receives and holds the tubes. The pivot arm can pivot to a position proximate the tray and release the tube. The tray can be rotatable and translatable to facilitate transfer of the tube from the pivot arm to the tray.

25 Claims, 18 Drawing Sheets

CORE TUBE HANDLING DEVICE

CROSS-REFERENCE TO RELATED APPLICATION

This application is a continuation of U.S. patent application Ser. No. 16/697,939, filed Nov. 27, 2019, which claims priority to and the benefit of the filing date of U.S. Provisional Patent Application No. 62/772,386, filed Nov. 28, 2018. Each of these applications is hereby incorporated herein by reference in its entirety.

FIELD

This invention relates to devices used with drilling rigs, in particular, rigs configured for diamond core drilling (diamond exploration drilling).

BACKGROUND

Diamond core drilling rigs are used to retrieve core samples from rock strata at depths of 1800 meters or more. The core samples can be analyzed to determine if the sample site has potential for mining operations. Such exploratory rigs can use annular (e.g., annular diamond-impregnated) drill bits attached to the end of hollow drill rods to cut a cylindrical core sample from the solid rock. Core samples can be retrieved using a core tube (also known as an "inner tube" or a "core barrel"), a hollow receptacle positioned within the rod string. As the core is drilled, the core tube can slide over the rock core sample. An overshot, attached to the core tube and to a winch by a cable, may be used to retrieve the core tube from inside the rod string. Retracting the winch can pull the core tube to the surface.

Once at the surface the core tube must be maneuvered to a position where the overshot can be removed and the core sample removed from the core tube. The challenge is to handle a core tube, which can be 3-6 meters long and weigh 120 kg or more, dangling from the winch cable. Prior art techniques require the awkward and heavy core tubes to be physically man-handled by the drilling crew. There are clearly physical challenges and safety concerns (e.g., associated with lifting heavy weight and working at dangerous heights) associated with this process.

SUMMARY

Disclosed herein, in various aspects, is a handling device for moving core tubes in a drilling apparatus, the drilling apparatus having a mast for supporting a drill string. The device can comprise a slew arm mountable on the mast in an orientation parallel thereto. The slew arm can be pivotable toward and away from the mast about a first axis oriented parallel to the mast and offset therefrom. A pivot arm can be mounted on the slew arm. The pivot arm can be movable between a first orientation parallel to the slew arm and a second orientation transverse to the slew arm. A core tube handling assembly can be mounted on the pivot arm and can be movable lengthwise therealong. The core tube handling assembly can be configured to receive and lift a core tube.

The handling assembly can comprise a first clamp having first and second jaws movable toward and away from one another for gripping the core tubes.

The core tube handling assembly can comprise a structure defining a receiving space that is configured receive at least a portion of an inner tube assembly that comprises the core tube and a spear. A spear attachment can comprise a receptacle that is configured to releasably receive and couple to the spear of the inner tube assembly. The spear attachment device can define a radially extending flange. The structure of the handling device can be configured to engage the radially extending flange of the spear attachment on opposing sides of the receptacle of the spear attachment.

The handling device can further comprise at least one bracket for attaching the slew arm to the mast. The at least one bracket can comprise a spar attachable to the mast. A swing arm can have a first end pivotably attached to the spar. A second end can attach to the slew arm. An actuator operating between the spar and the swing arm can effect pivoting motion of the slew arm toward and away from the mast about the first axis. The actuator can optionally comprise a hydraulic cylinder.

The pivot arm can be pivotably attached to the slew arm for pivoting motion about a second axis oriented transversely to both the slew arm and the pivot arm. The handling device can further comprise an actuator acting between the pivot arm and the slew arm for effecting pivoting motion of the pivot arm about the second axis. The actuator can optionally comprise a hydraulic cylinder.

The handling device can further comprise a guide rail mounted on the pivot arm and oriented lengthwise therealong. A carriage can be mounted on the guide rail and movable therealong. The first clamp can be mounted on the carriage. A first actuator can be mounted on the carriage. The first actuator can act between the first and second jaws for effecting gripping of the core tubes. A second actuator can be mounted on the pivot arm for effecting motion of the carriage lengthwise therealong. The first actuator can optionally comprise a hydraulic cylinder. The second actuator can optionally be an endless chain arranged lengthwise along the pivot arm or a rack-and-pinion drive.

A second clamp can be mounted on the pivot arm. The second clamp can comprise first and second jaws movable toward and away from one another for gripping the core tubes. The handling device can further comprise an actuator acting between the first and second jaws of the second clamp. The actuator can optionally comprise a hydraulic cylinder.

The second clamp can be fixedly mounted on the pivot arm.

The handling device can further comprise a tray for receiving the core tubes. The tray can define a longitudinal axis oriented transversely to the slew arm and aligned with the pivot arm when the slew arm is pivoted away from the mast.

The tray can be movable toward and away from the pivot arm to receive the core tube therefrom when the pivot arm is oriented parallel to the tray.

The tray can comprise a bar of a four bar linkage to effect motion of the tray toward and away from the pivot arm.

The tray can comprise a first trough having opposing sidewalls spaced to receive one of the core tubes. The tray can further comprise a second trough having opposing sidewalls spaced to receive the one core tube, the second trough being aligned with the first trough. A link can extend between the first and second troughs. The link can define a gap in the tray for accommodating the first clamp when the one core tube is received in the tray.

The tray can comprise a first receptacle and a second receptacle that is parallel to the first receptacle.

The tray can be rotatable about the longitudinal axis to selectively alternate between alignment of the first receptacle of the tray with the pivot arm and alignment of the second receptacle of the tray with the pivot arm.

The pivot arm can be configured to be coupled to the slew arm so that the pivot arm is fixed an orientation that is substantially parallel to the slew arm.

The handing device can further comprise an overshot tube mounted on the slew arm, the overshot tube sized to receive an overshot from the core tube.

A drilling rig can use core tubes in exploration drilling. The drilling rig can comprise a mast. A slew arm can be mounted on the mast in an orientation parallel thereto. The slew arm can be pivotable toward and away from the mast about a first axis oriented parallel to the mast and offset therefrom. A pivot arm can be mounted on the slew arm. The pivot arm can be movable between a first orientation parallel to the slew arm and a second orientation transverse thereto. A core tube handling assembly can be mounted on the pivot arm and can be movable lengthwise therealong. The core tube handling assembly can be configured to receive and lift a core tube.

A method can comprise removing an inner tube assembly from a drill string with a drill rig. The drilling rig can comprise a mast. A slew arm can be mounted on the mast in an orientation parallel thereto. The slew arm can be pivotable toward and away from the mast about a first axis oriented parallel to the mast and offset therefrom. A pivot arm can be mounted on the slew arm. The pivot arm can be movable between a first orientation parallel to the slew arm and a second orientation transverse thereto. A core tube handling assembly can be mounted on the pivot arm and can be movable lengthwise therealong. Removing the inner tube assembly from the drill string can comprise using the core tube handling assembly to receive and lift a core tube of the inner tube assembly.

The drill rig can comprise a wireline assembly comprising an overshot. Removing the inner tube assembly can comprise maintaining a coupling between the overshot and the inner tube assembly while pivoting the pivot arm with respect to the slew arm.

The drill rig can comprise a wireline assembly comprising an overshot. Removing the inner tube assembly can comprise decoupling the overshot from the inner tube assembly before pivoting the pivot arm with respect to the slew arm.

The core tube handling assembly can comprise a first clamp comprising first and second jaws movable toward and away from one another for gripping the core tubes. The drill rig can further comprise a carriage that is movable along the length of the pivot arm, a first actuator that is configured to effect movement of at least one of the first and second jaws of the first actuator for effecting gripping of the core tubes, and a second actuator mounted on the pivot arm for effecting motion of the carriage lengthwise therealong. A second clamp can be mounted on the pivot arm. The second clamp can comprise first and second jaws movable toward and away from one another for gripping the core tubes. Removing the inner tube assembly from the drill string can comprise: gripping the inner tube assembly with first clamp, moving the carriage away from the second clamp, gripping the inner tube assembly with the second clamp, releasing the inner tube assembly with the first clamp, moving the carriage toward the second clamp, griping the inner tube assembly with the first clamp, releasing the inner tube assembly with the second clamp, and moving the carriage away from the second clamp.

DETAILED DESCRIPTION

Figure 1:
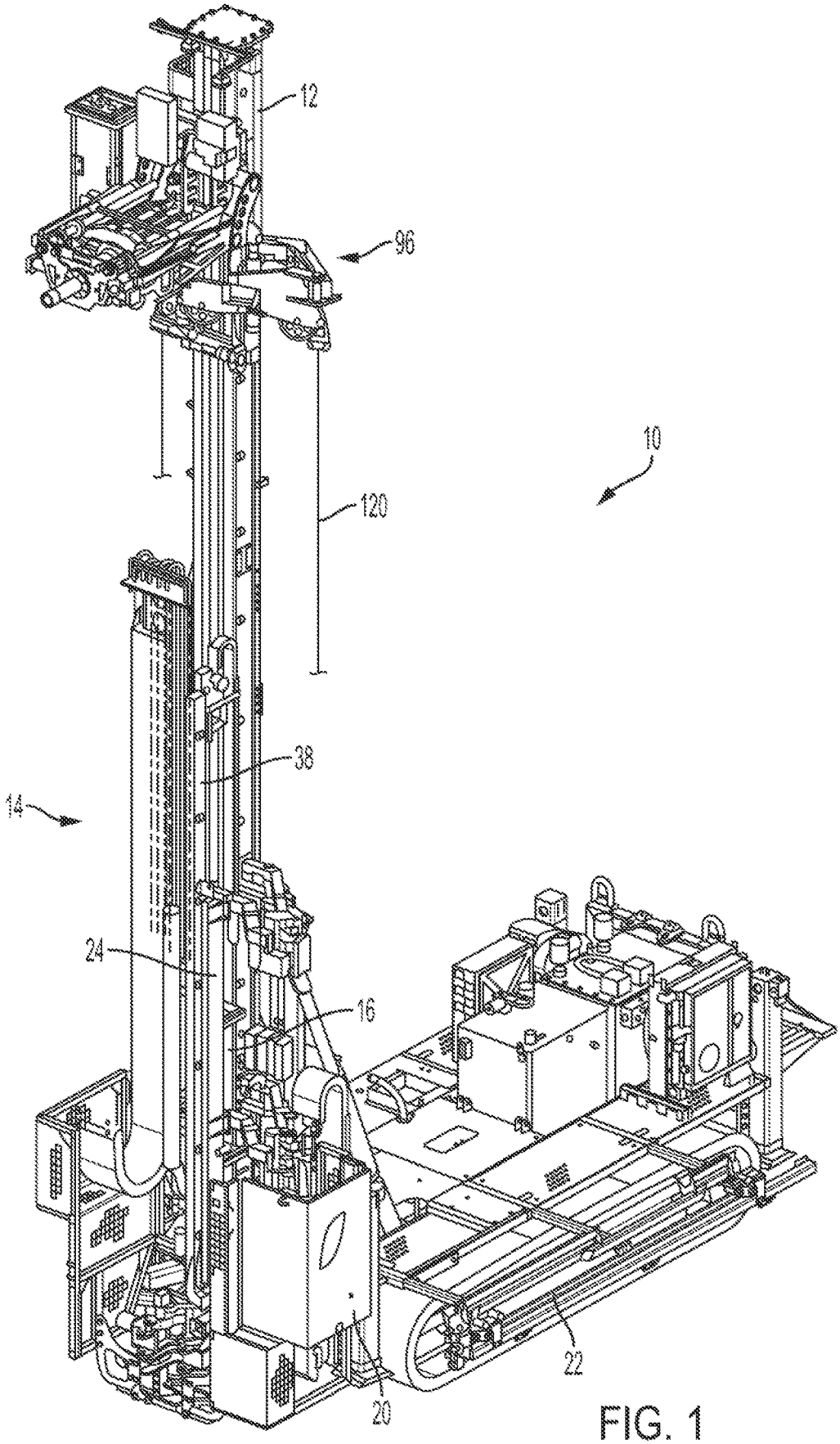
FIG. 1 is a front isometric view of an example drilling rig and core tube handling device in accordance with the present disclosure.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms “a,” “an,” and “the” include plural referents unless the context clearly dictates otherwise. For example, use of the term "a clamp" can refer to one or more of such clamps, and so forth.

All technical and scientific terms used herein have the same meaning as commonly understood to one of ordinary skill in the art to which this invention belongs unless clearly indicated otherwise.

As used herein, the terms "optional" or "optionally" mean that the subsequently described event or circumstance may or may not occur, and that the description includes instances where said event or circumstance occurs and instances where it does not.

As used herein, the term "at least one of" is intended to be synonymous with "one or more of" For example, "at least one of A, B and C" explicitly includes only A, only B, only C, and combinations of each.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 15%, up to 10%, up to 5%, or up to 1% (above or below) of the particularly stated value can be included within the scope of those aspects. Similarly, use of "substantially" (e.g., "substantially parallel") or "generally" (e.g., "generally planar") should be understood to include embodiments in which angles are within ten degrees, or within five degrees, or within one degree.

The word "or" as used herein means any one member of a particular list and also includes any combination of members of that list.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

Figure 2:
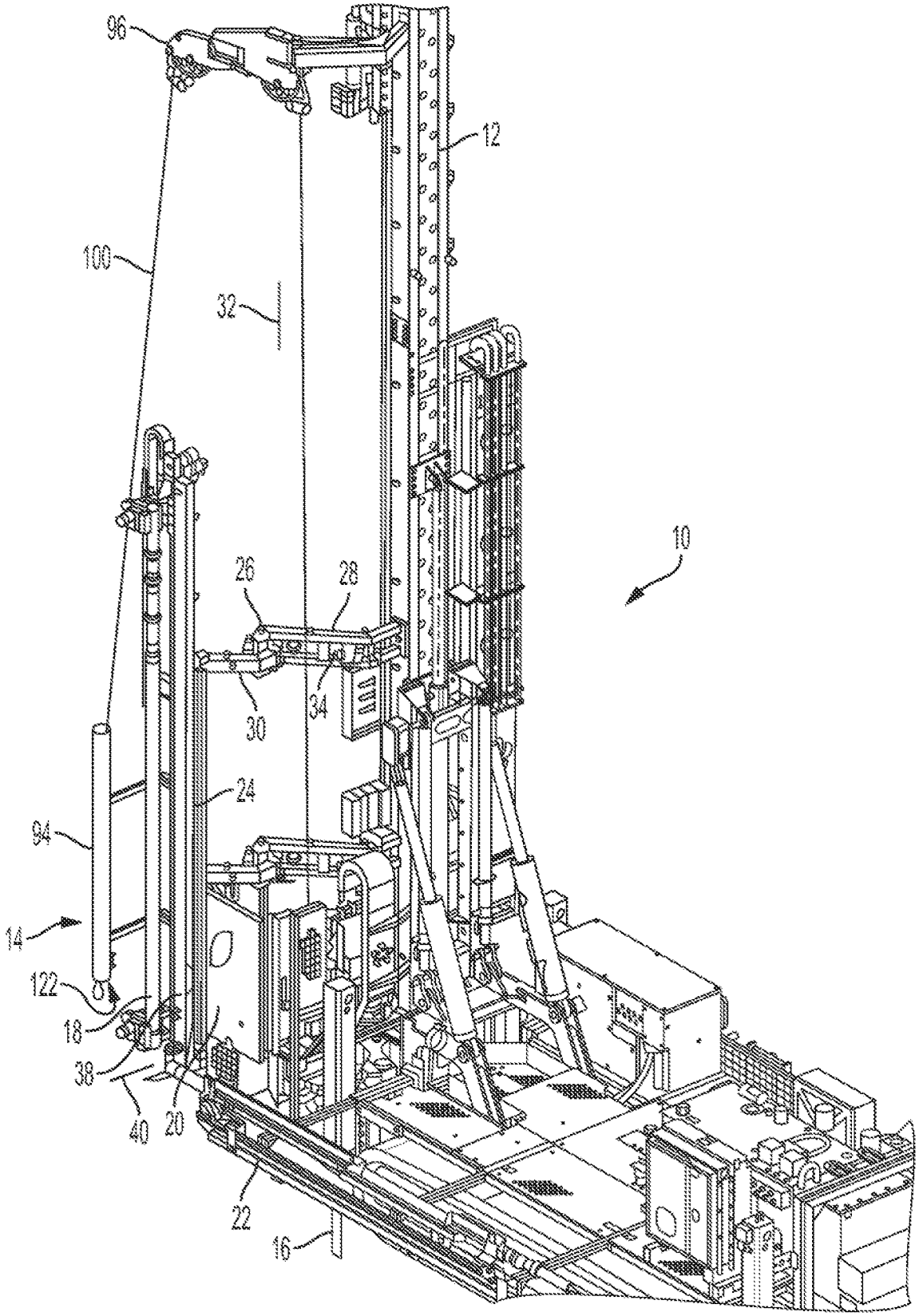
FIG. 2 is a rear isometric view of the example drilling rig and core tube handling device of FIG. 1.

FIGS. 1 and 2 show front and rear views, respectively, of a drilling rig 10, in this example, for diamond core drilling. A mast 12 can support a drill string 16 in which core tubes 18 are deployed for retrieving core samples. The core tubes 18 can be removed from the drill string 16 by a wireline apparatus 20 that can be mounted in front of, behind, or on top of the mast 12. The core handling device 14 can then move the core tubes 18 to a core tube tray 22 where the core samples can be removed from the core tubes for processing.

Figure 3:
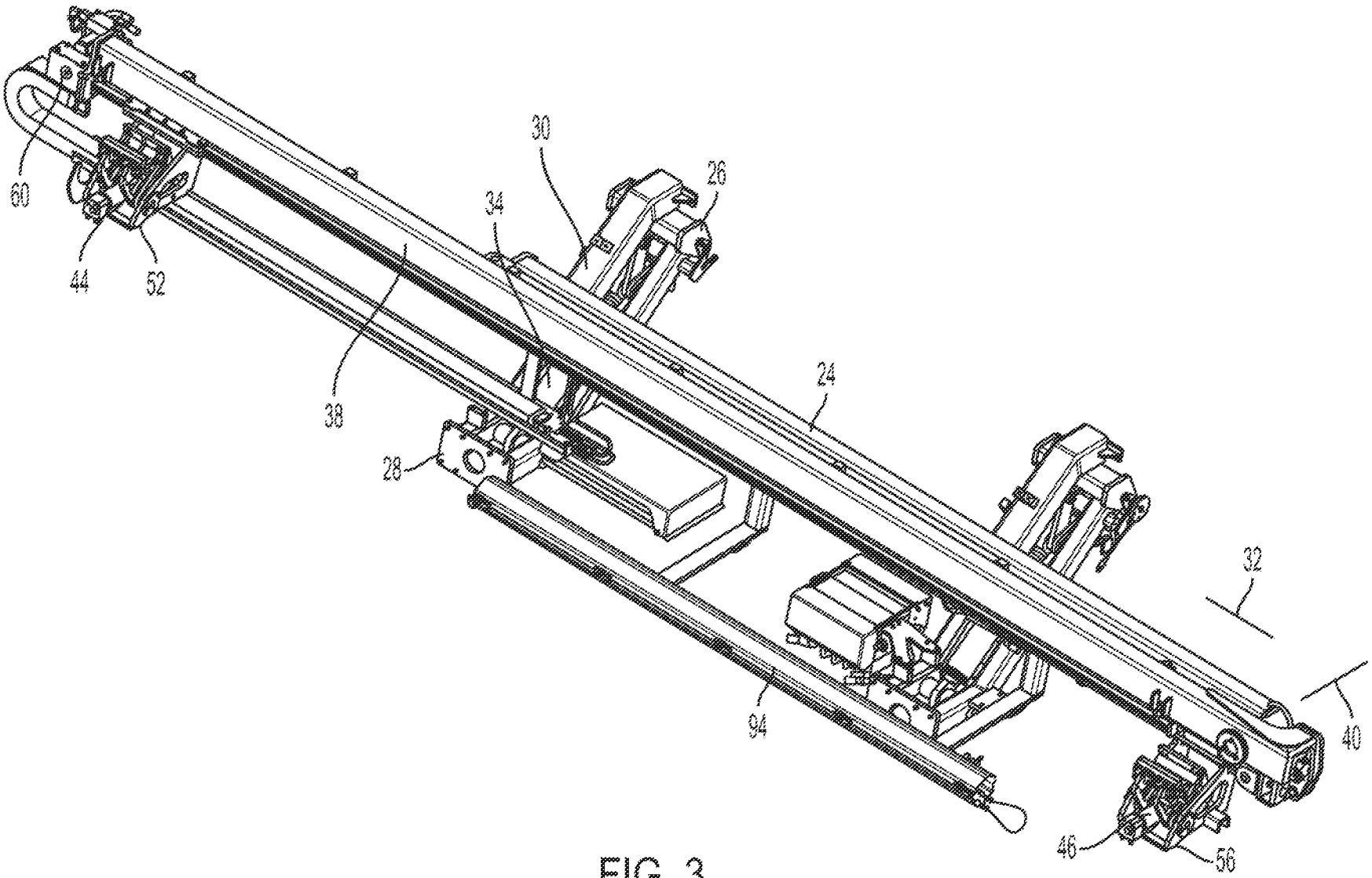
FIG. 3 is an isometric views of an example core tube handling device.
Figure 4:
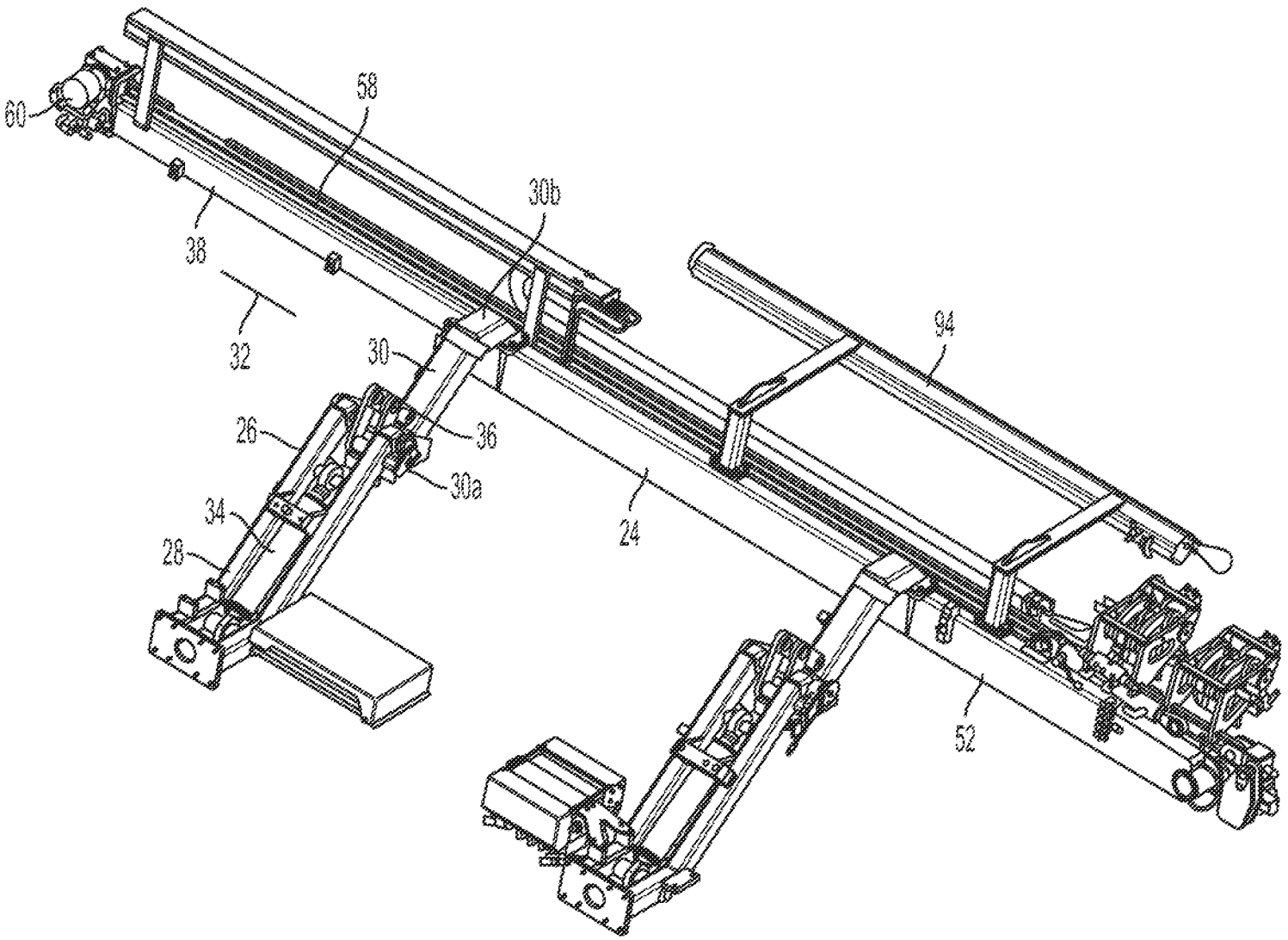
FIG. 4 is an isometric view of the example core tube handling device of FIG. 3A.

An example core tube handling device 14, shown in FIGS. 2-4, can comprise a slew arm 24. The slew arm 24 can be mounted on mast 12 and can be oriented parallel, or substantially parallel, thereto. At least one bracket 26 can be used to mount the slew arm 24 to the mast 12. Although two brackets are shown in FIGS. 2-4, it is contemplated that three or more brackets 26 can optionally be used, in particular, for long core tubes. Each bracket 26 can comprise a spar 28, attached directly to mast 12, and a swing arm 30 having a first end, 30*a*, attached to spar 28, and a second end, 30*b*, attached to slew arm 24. Swing arms 30 can be pivotably attached to respective spars 28 and can pivot about a first axis 32 oriented parallel to mast 12. As shown in a comparison of FIGS. 3 and 4, this arrangement of spars 28 and swing arms 30 can allow the slew arm 24 to pivot toward and away from mast 12 about first axis 32 that is offset from the mast 12. As shown in FIG. 2 and described further below, the offset of the first axis 32 from the mast 12 can permit the slew arm 24 to align with the core tube tray 22.

Pivoting motion of the slew arm 24 toward and away from the mast 12 can be effected by one or more actuators 34. Each actuator can be mounted on a respective bracket 26 and can operate between the spar 28 and the swing arm 30. As shown in the illustrated embodiments, the actuators 34 can comprise hydraulic pistons. In further embodiments, other actuators, such as electrical motors and hydraulic rotators are also feasible. A full 180° pivot of the slew arm 24 relative to mast 12 can be enabled by the use of an eccentric lever 36 or other mechanical linkage positioned between the actuator 34 and the swing arm 30.

Figure 5:
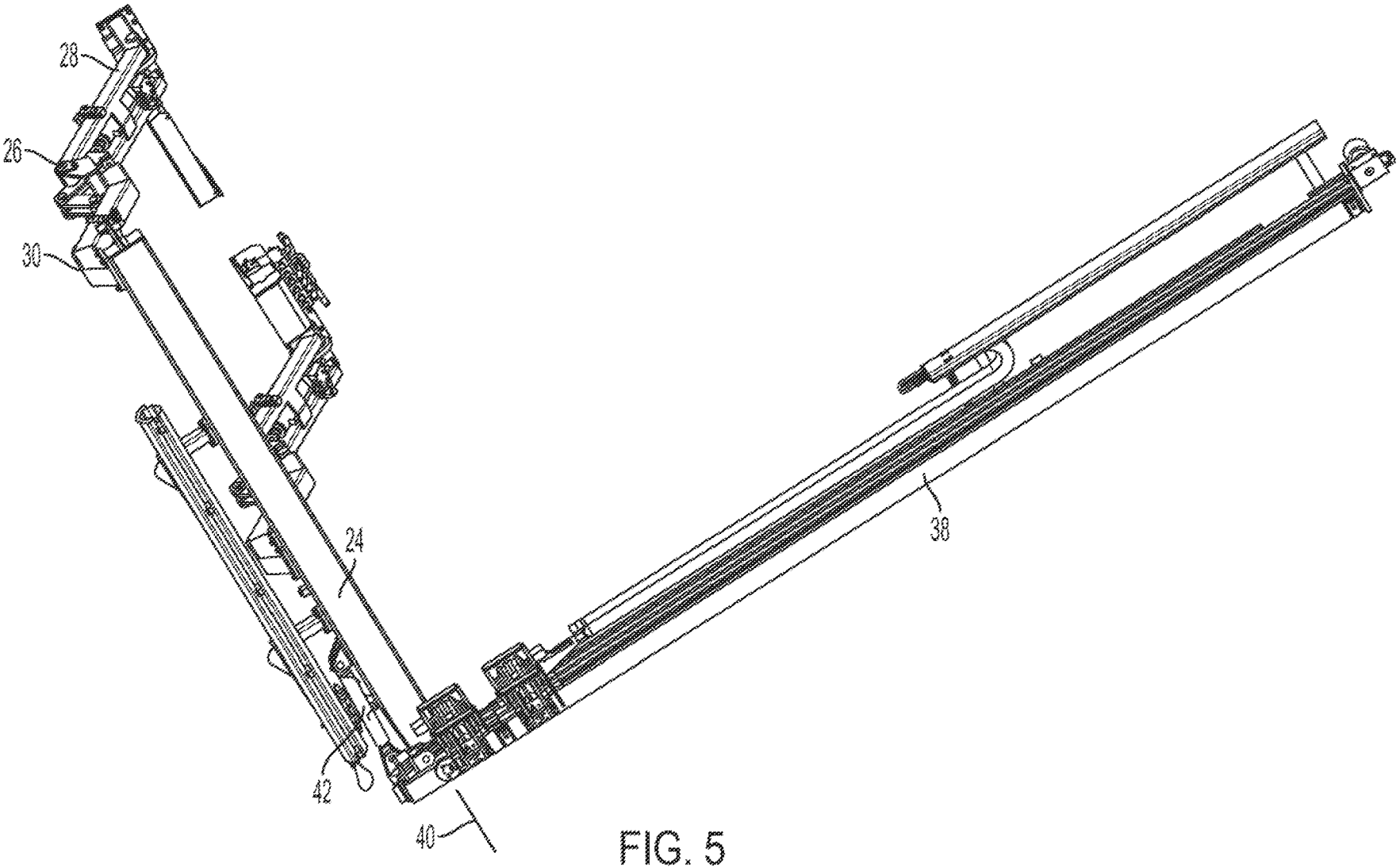
FIG. 5 is an isometric view of the core tube handling device shown in FIGS. 3 and 4.

As shown in FIGS. 2 and 5, a pivot arm 38 can be mounted on the slew arm 24. Pivot arm 38 can be pivotably movable about a second axis 40 that is oriented transversely or substantially transversely to both the slew arm 24 and the pivot arm 38. This orientation of second axis 40 can permit pivot arm 38 to move between a first orientation that is parallel or substantially parallel to the slew arm 24 (see FIG. 2) and a second orientation that is transverse or substantially transverse to the slew arm (see FIG. 5), in this example, at 90° to the slew arm. Pivoting motion of the pivot arm 38 relative to the slew arm 24 can be effected by an actuator 42 acting between the pivot arm and the slew arm. In this example the actuator 42 comprises a hydraulic piston, but could also be an electric motor or a hydraulic rotator or other suitable actuator.

Figure 15:
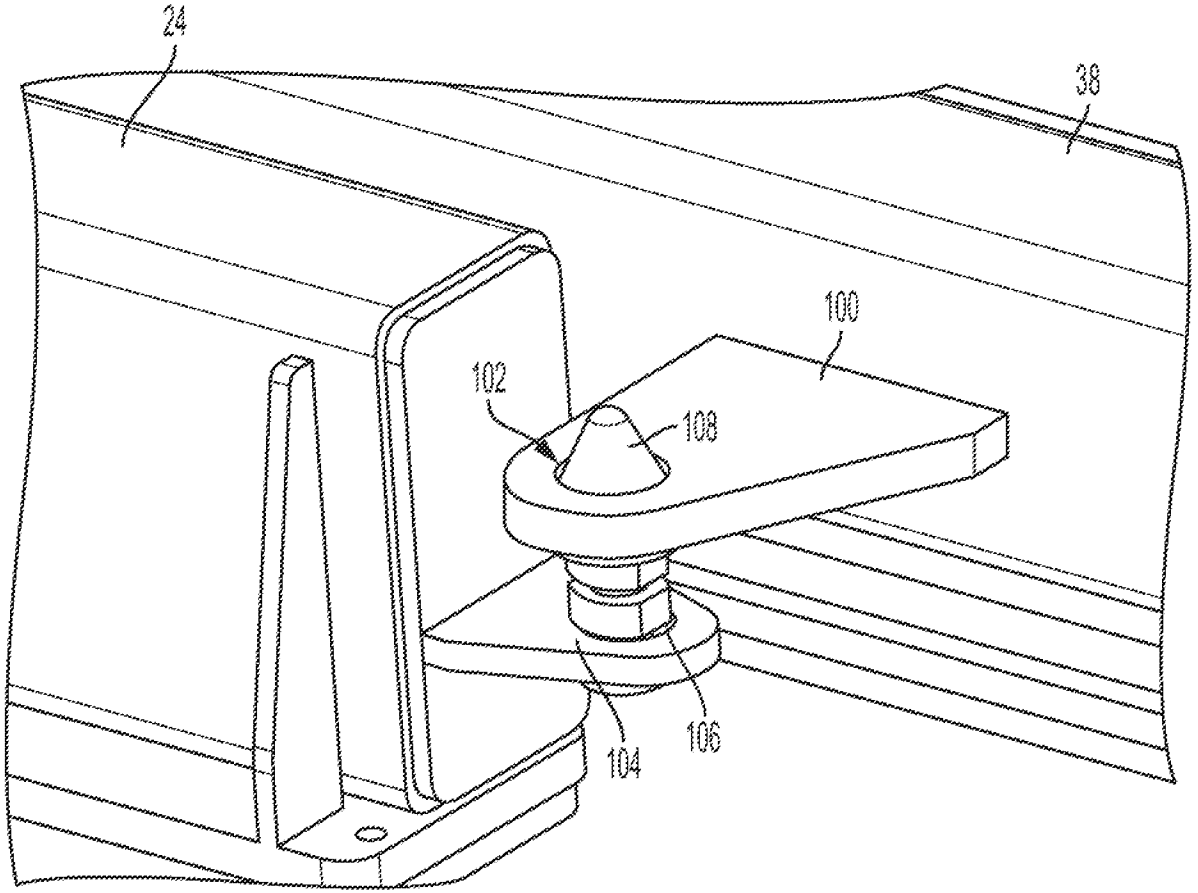
FIG. 15 is a close-up detail perspective view of a coupling between the pivot arm and the slew arm of the core tube handling device of FIG. 1.

Referring to FIG. 15, the pivot arm 38 can optionally be coupled to the slew arm 24 to retain the pivot arm 38 in the first orientation. For example, a first attachment flange 100 can extend from the pivot arm 38. The first attachment flange 100 can define a through-hole 102. When the pivot arm 38 is in the first orientation, the through-hole 102 can align with a through-hole 106 in an attachment flange 104 that extends from the slew arm 24. The through-holes 102 and 106, when aligned, can receive a bolt 108 therethrough, thereby retaining the pivot arm 38 to the slew arm 24 in the first orientation. According to further optional aspects, the bolt 108 can mate with female threads in the hole 106 of the flange 104. Accordingly, bolt 108 can be rotated adjust its axial position with respect to the flange 104, thereby engaging and disengaging the hole 102 (which can be an unthreaded clearance hole) in the flange 100. In still further optional aspects, the bolt 108 can threadedly engage threads in the hole 102 of the flange 100, and rotation of the bolt 108 can move the bolt axially to selectively extend into and back away from the hole 106 (which can be an unthreaded clearance hole) in the flange 104.

The pivot arm 38 and the slew arm 24 can be beneficially coupled during transport of the rig, when moving the slew arm 24, or when pulling the core tube from the drill string, or when inserting the core tube into the drill string. As the pivot arm 38 can be supported in a cantilevered fashion, the coupling between the pivot arm and the slew arm 24 can minimize movement due to flexion between the pivot arm and slew arm as well as reduce loading on the coupling between the pivot arm and the slew arm.

In exemplary aspects, the handling device 14 can comprise at least one handling assembly that is mounted on the pivot arm 38 and moveable along the length of the pivot arm as further disclosed herein. In use, it is contemplated that the handling assembly can receive and/or lift a portion of a core tube, through either direct or indirect engagement or coupling. While specific examples of the handling assembly are provided herein, it is contemplated that any suitable handling or engagement structure can be used. Exemplary engagement structures that can serve as handling assemblies include jaws, grippers, rollers as are known in the art. Optionally, it is contemplated that grippers and rollers can comprise contact/gripping pads that are configured to engage a portion of a core tube. Optionally, it is contemplated that the jaws, grippers, and rollers can be formed from infiltrated bodies comprising diamond or tungsten carbide mixtures. Other exemplary handling assemblies include electromagnets that can be selectively activated to establish a magnetic attraction between the handling assembly and the core tube, thereby permitting safe handling of the core tube during movement of the handling assembly. According to some optional aspects, a first electromagnet, or a first plurality of electromagnets can be movable on the carriage 52, and a second electromagnet, or plurality of electromagnets, can be on a fixed position on the pivot arm (e.g., on the bottom of the pivot arm where the clamp 46 is shown in the Figures). Optionally, the electromagnets can be disposed within respective wedge-shaped housings that have longitudinal axes that are parallel to the longitudinal dimension of the pivot arm. In this way, when the electromagnets are activated, an induced magnetic field can attract the inner tube assembly against the converging sidewalls of the wedge-shaped housing to bias the inner tube assembly toward a fixed position relative to axes that are perpendicular to the longitudinal dimension of the pivot arm. In still further embodiments, the handling device 14 can comprise one or more clamps and one or more electromagnetic handling assemblies.

Figure 6:
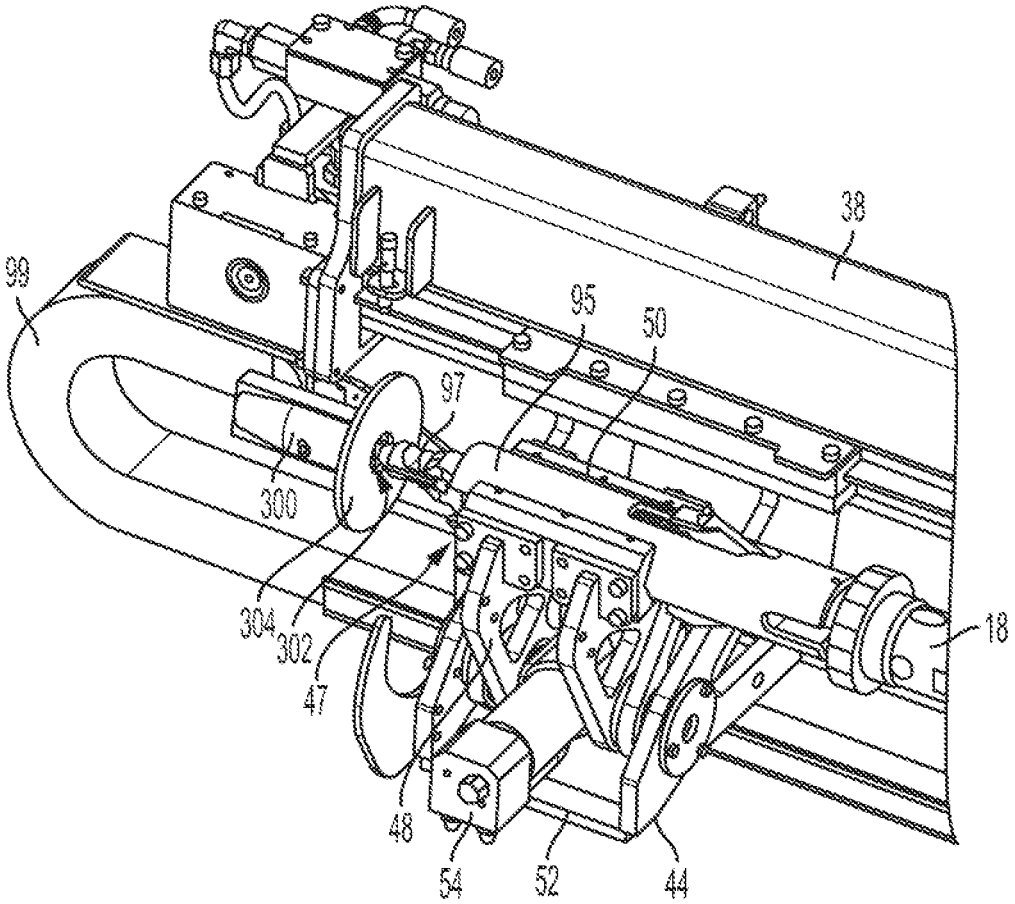
FIGS. 6-8 are isometric views of portions of the core tube handling device shown in FIG. 5.
Figure 8:
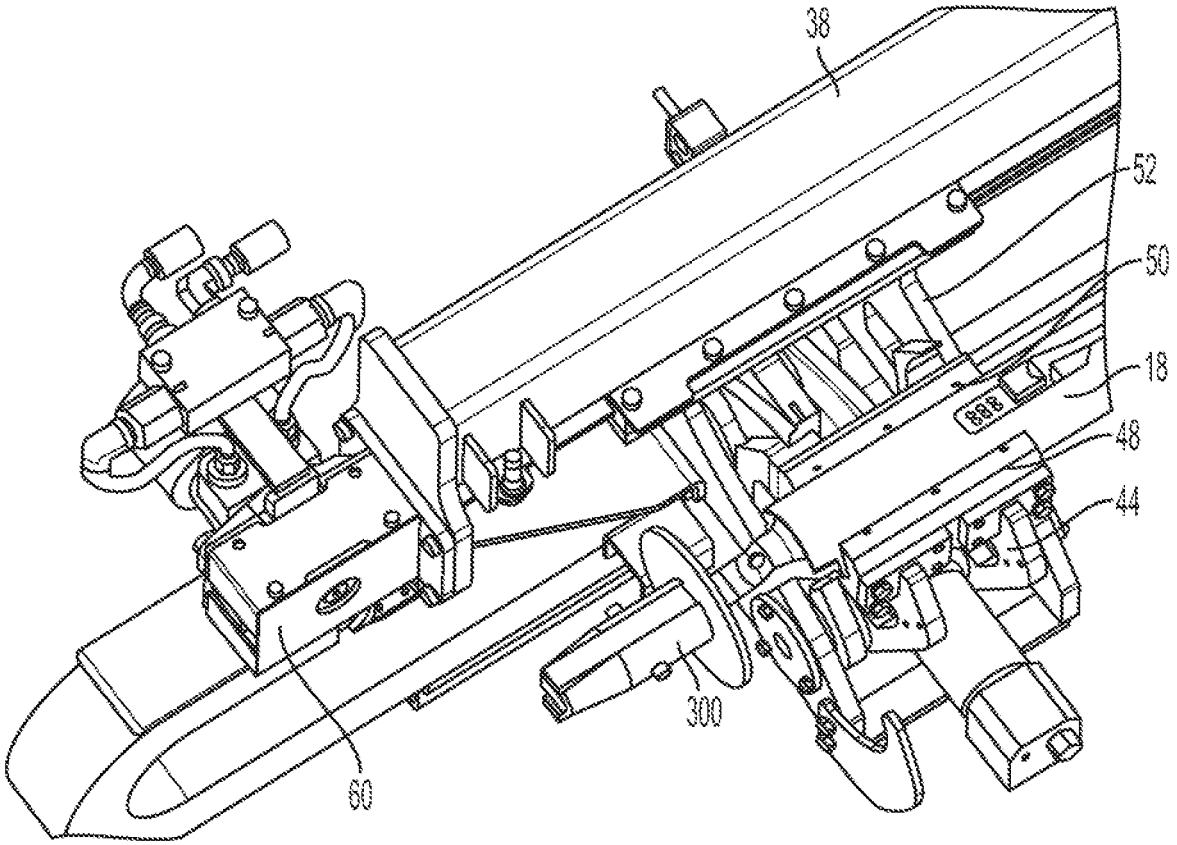

As shown in FIG. 3, in exemplary aspects, the handling device 14 can comprise a plurality of handling assemblies. A first handling assembly can comprise a first clamp 44 that can be mounted on pivot arm 38, proximate one end thereof. A second handling assembly can comprise a second clamp 46 that can be mounted proximate the other end of the pivot arm. As shown in FIGS. 6 and 8, clamps 44 and 46 can each comprise first and second jaws 48 and 50 that are movable toward and away from one another for gripping core tubes 18. Jaws 48 and 50 of the first clamp 44 can be mounted on a mobile carriage 52. A first actuator 54, also mounted on carriage 52, can act between jaws 48 and 50 to effect gripping of the core tubes. According to various aspects, the first actuator 54 can comprise a hydraulic piston. In further aspects, the first actuator 54 can comprise an electrical motor or hydraulic rotator. The second clamp 46 can be similar to clamp 44, but can be mounted on a stationary bracket 56 that is attached to the pivot arm 38 (see FIG. 3). A conduit 99 can protect hydraulic and/or electrical lines. The conduit 99 can optionally be flexible to move with the mobile carriage 52.

Figure 14C:
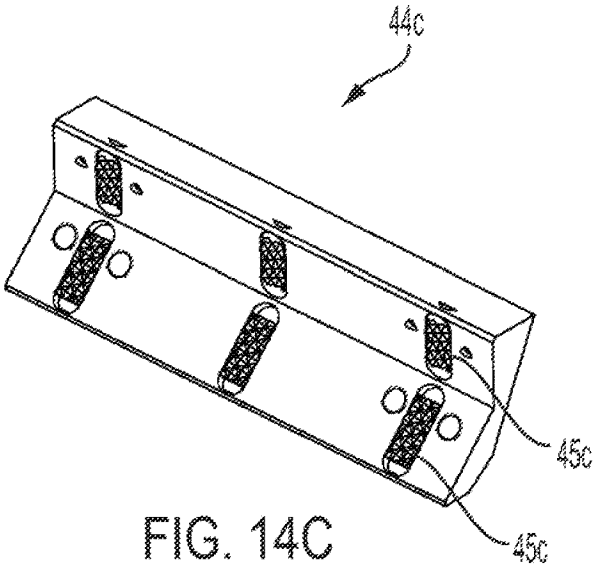
FIG. 14C is a perspective view of a clamp having textured engagement portions.
Figure 14B:
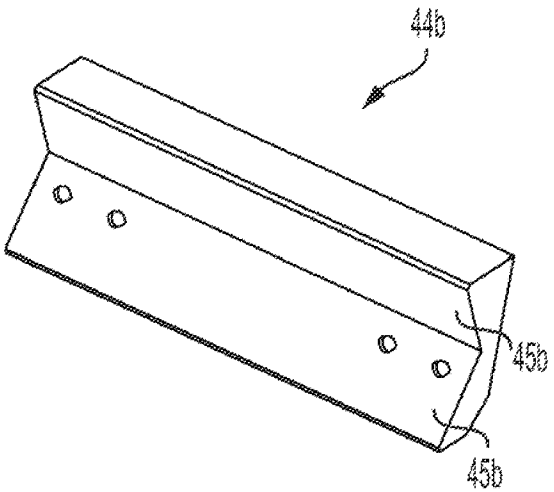
FIG. 14B is a perspective view of a clamp having smooth engagement portions.
Figure 14A:
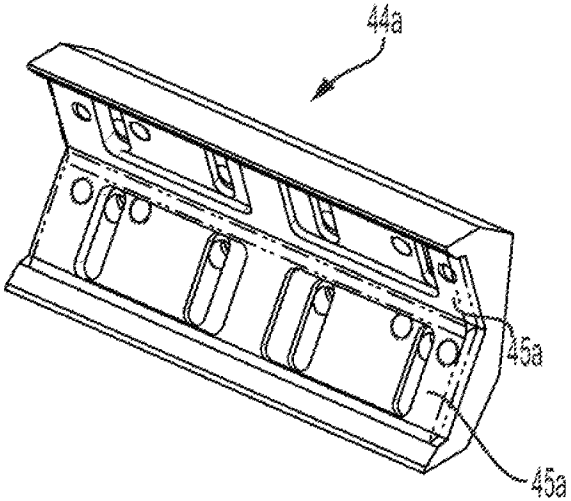
FIG. 14A is a perspective view of a clamp having silicone engagement portions.

Referring also to FIGS. 14A-14C, the first and second clamps 44, 46 can be selected based on the application and type of material being held. For example, a clamp 44*a* can comprise silicone engagement portions 45*a* that can be overmolded into, or releasably inserted into, the clamp jaws to thereby define interior clamping surfaces of the clamp jaws. The silicone can prevent scratching as well as provide high frictional engagement to inhibit slipping. A clamp 44*b* can comprise smooth jaws made of, for example, mild steel. That is, the inner surface of the jaws can comprise untextured surfaces 45*b*. The smooth jaws can be used as guiding jaws that allow for slipping. A clamp 44*c* can comprise jaws with carbide engagement surfaces 45*c*. For example, the jaws can comprise mild steel, and carbides or other gripping surfaces can be soldered or otherwise secured to the mild steel components. The carbide surfaces (and other gripping surfaces) can enable maximum strength grip using high clamping pressure in applications where a scratch-free outer surface is not critical. In still further optional aspects, the jaws can have a gripping surface comprising diamond particles (e.g., diamond powder) embedded within a matrix. For example, inserts comprising diamond particles in a matrix can be inserted into respective slots within steel jaws (e.g., in a similar configuration to that shown in FIG. 14C). In various embodiments, the gripping surfaces of the jaws can be smooth or textured, and can further comprise bronze, polymer, or various other materials. Optionally, in some aspects, it is contemplated that the gripping surfaces and the main bodies of the jaws can be integrally formed as one piece following an infiltration process. The clamps, or the jaws of the clamps, can optionally be interchangeable. For example, optionally, the silicone engagement portions can be removed and replaced with polymer engagement portions.

Figure 16C:
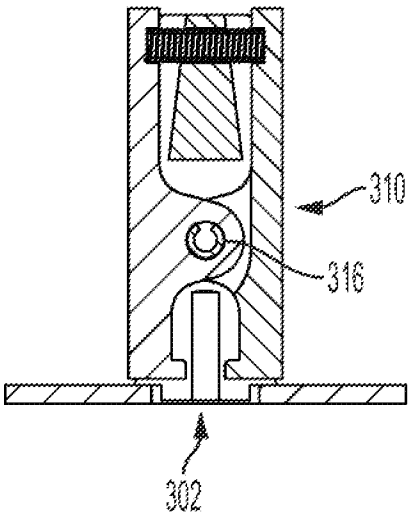
FIG. 16C is a cross sectional view of the spear attachment of FIG. 16A.
Figure 16B:
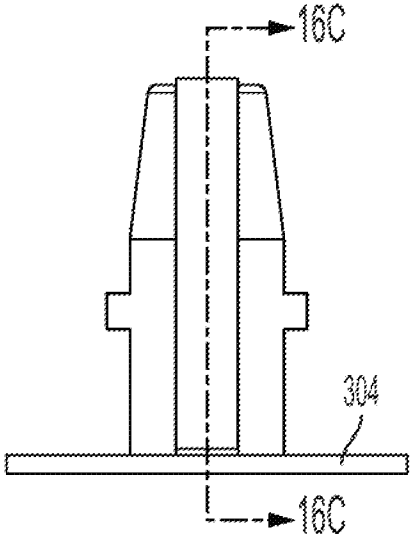
FIG. 16B is a side view of the spear attachment of FIG. 16A.
Figure 16A:
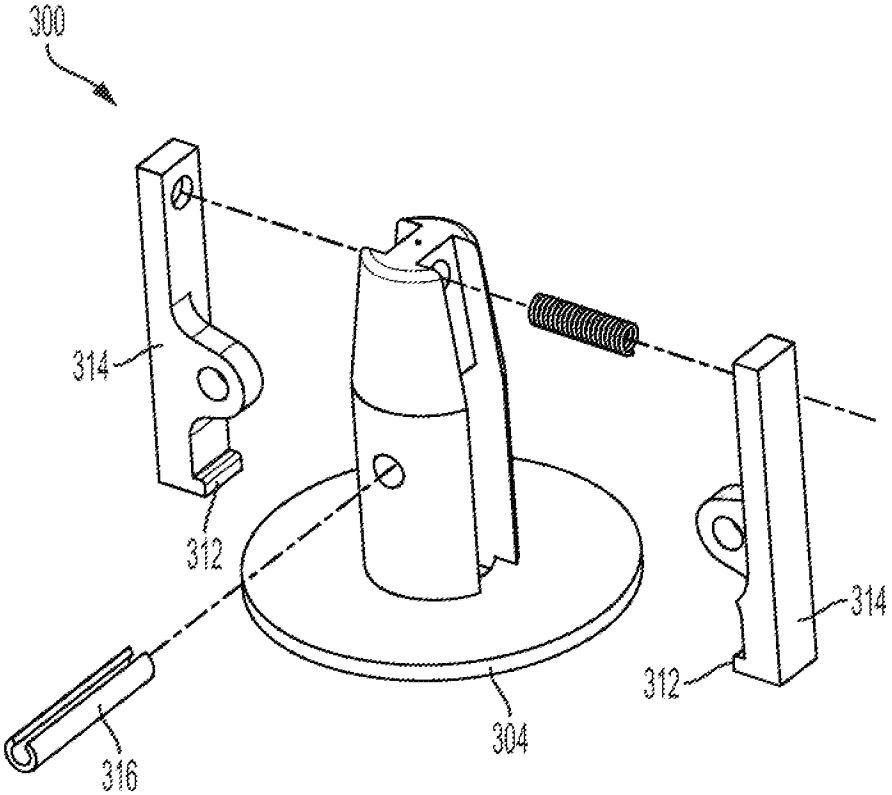
FIG. 16A is an exploded view of a spear attachment.
Figure 17A:
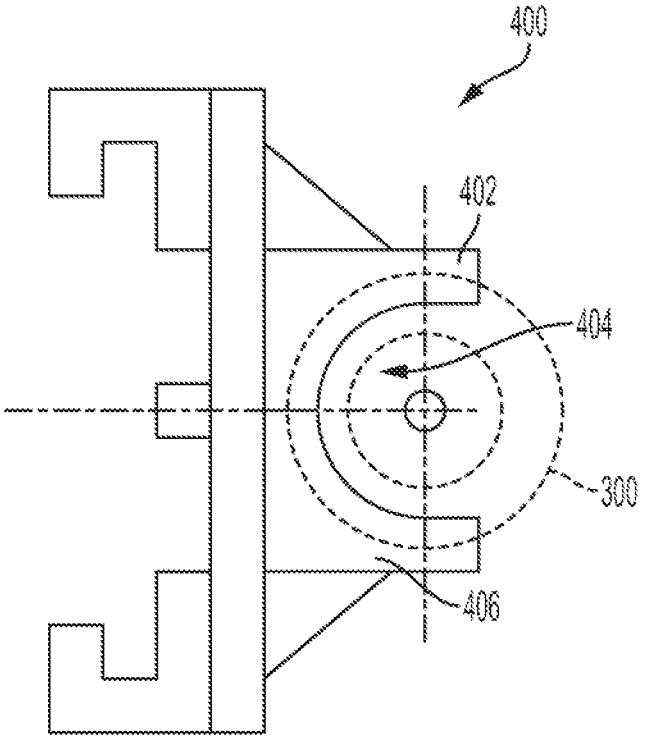
FIG. 17A is a top view of a spear attachment engagement structure.
Figure 17B:
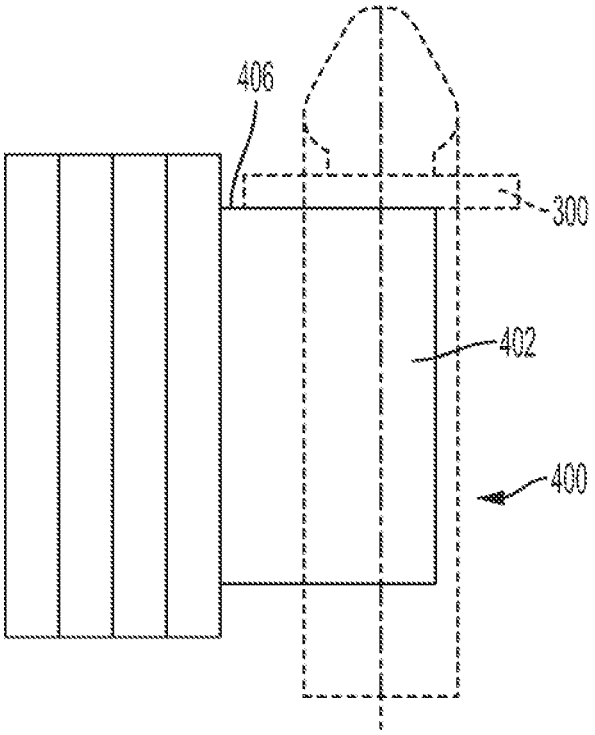
FIG. 17B is a side view of the spear attachment engagement structure of FIG. 17A.
Figure 18B:
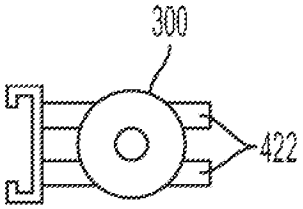
FIG. 18B is a top view of the exemplary spear attachment engagement structure.
Figure 18A:
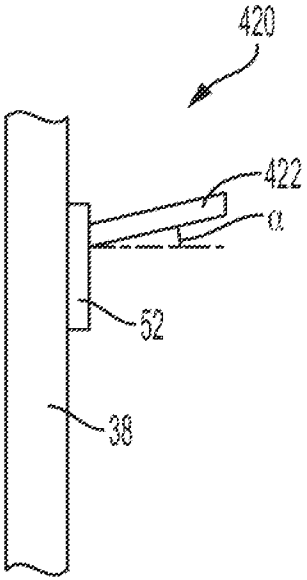
FIG. 18A is a side view of another exemplary spear attachment engagement structure.

According to some aspects, the core tube 18 can be a portion of an inner tube assembly 95. The inner tube assembly 95 can further comprise a spear 97. Referring also to FIGS. 16A-C, in some embodiments, the handling assembly of the handling device 14 can comprise a spear attachment 300, which can define a receptacle 302 that is configured to receive the spear 97 of the inner tube assembly 85. The spear attachment 300 can further be configured to latch to the spear 97. For example, the spear attachment 300 can comprise a clip portion 310. The clip portion 310 can comprise protrusions 312 on ends of levers 314 that are configured to engage the spear 97 of the inner tube assembly. The levers 314 can be pivotable about a spring pin 316. A spring 318 can bias the levers so that the protrusions 312 engage the spear 97. The spear 97 can define a recess, a groove, or other reduced diameter portion that receives at least a portion of the protrusions 312. An operator can press ends 320 of the levers 314 toward each other to engage or release the spear 97.

The spear attachment 300 can define a flange 304 that extends perpendicularly or substantially perpendicularly outward relative to the receptacle 302 of the spear attachment so that, when coupled to the spear 97, the flange 304 is perpendicular or generally perpendicular to the longitudinal axis of the inner tube assembly 95.

The spear attachment 300 can be configured to enable the first clamp 44 to optionally hold the inner tube assembly 95 without clamping down against the inner tube assembly. Instead, the first clamp 44 can define a partial circumferential enclosure that can at least partially surround a portion of the inner tube assembly 95, leaving clearance so that the inner tube assembly 95 can slide longitudinally. The first clamp 44 can then move vertically until the flange 304 engages and biases against an upper end 47 of the clamp 44.

In further embodiments, the first clamp 44 is not necessary and can optionally be excluded from the core tube handling device. Rather, a spear attachment engagement structure 400 can attach to the carriage 52. According to some aspects, the structure 400 can define a receiving space that can receive and at least partially surround a portion of the inner tube assembly. In some optional aspects, the spear attachment engagement structure 400 can comprise at least one body 402 that defines a receiving space 404 (e.g., a rectangular or cylindrical receiving space) that can receive and at least partially surround a portion of the inner tube assembly. An upper surface 406 of the body 402 can define an engagement surface that can engage the lower side of the flange 304 of the spear attachment 300.

According to further aspects, an exemplary embodiment of a spear attachment engagement structure 420 can comprise a pair of rods 422 that extend from the pivot arm 38 and define a receiving space 424 therebetween. The rods 422 can extend from pivot arm at an upward angle, $\alpha$, with respect to the horizontal (e.g., five degrees, fifteen degrees, thirty degrees, or more with respect to the horizontal). Optionally, the upward angle can range from about 5 degrees to about 60 degrees or from about 10 degrees to about 45 degrees with respect to the horizontal. In this way, gravity can bias the inner tube assembly toward, rather than away from, the pivot arm. Similarly, the upper surface 406 of the structure 400, can have a downward slope toward the pivot arm 38 that biases inner tube assembly toward the pivot arm.

The flange 304 of the spear attachment 300 can bias against the top of the structure 400 (or the structure 420) so that the spear attachment 300 and the structure 400 (or structure 420) can cooperate to hold the inner tube assembly. For example, the structure 400 can engage the lower side of the flange 304 on opposing sides of the receptacle 302 of the spear attachment 300. Accordingly, a holding device that can be used as an alternative to the first clamp 44 can comprise the spear attachment engagement structure 400 (or the structure 420 or other suitable structure) and the spear attachment 300.

In some embodiments, the handling device can manipulate the inner tube assembly 95 while the inner tube assembly is detached from the overshot. In further embodiments, the handling device can manipulate the inner tube assembly 95 while the inner tube assembly is coupled to an overshot and wireline. A sheave roller assembly 96 can guide the wireline cable to enable the overshot to stay coupled to the inner tube assembly 95 as the handling device manipulates inner tube assembly (e.g., movement via the slew arms, tilting of the pivot arm, and translation along the pivot arm). The sheave roller assembly 96 can couple to an upper end of the mast 12. The sheave roller assembly 96 can comprise a sheave that is coupled to the mast via a swing mount. The swing mount can be pivotable about a vertical axis. In some situations, the ability of the overshot to stay connected to the inner tube assembly as the holding device manipulates the inner tube assembly can depend on the position of the wireline winch, the fine control of the wireline winch to maintain suitable tension on the cable, the existence and range of motion of the sheave roller assembly 96, and the position of wireline winch with respect to the sheave roller assembly 96 and the core tube handling device 14. As can be understood, in some applications, the system can prevent the cable from dragging against surfaces of the drill rig 10.

Figure 7:
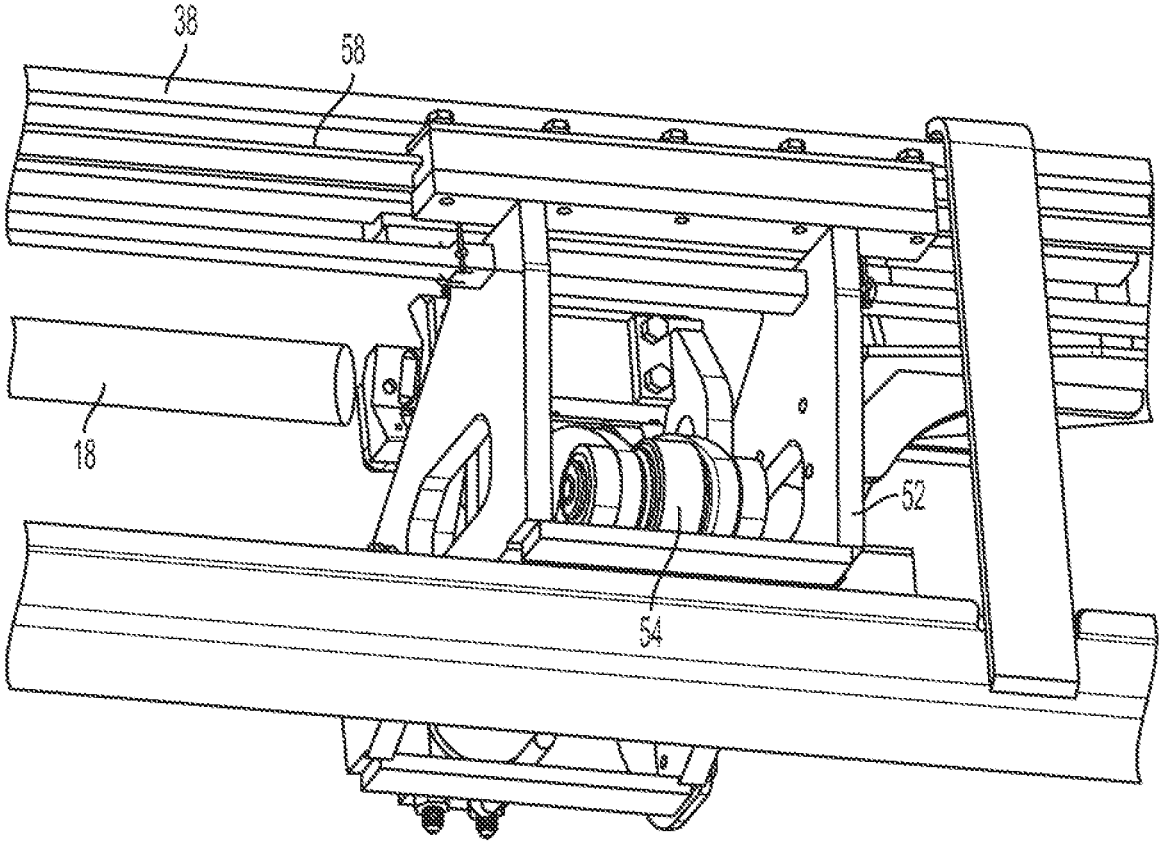

As shown in FIG. 7, the carriage 52 can be mounted on a guide rail 58 that extends lengthwise along the pivot arm 38. As shown by a comparison of FIGS. 3 and 4, the carriage 52 can be movable along the pivot arm 38 toward and away from the second axis 40 along the guide rail 58. A second actuator 60, shown in FIG. 8, can effect motion of the carriage 52 along the guide rail 58. According to some aspects, the second actuator 60 can comprise an endless chain that can be driven by a hydraulic or an electric motor. In further aspects, the second actuator 60 can comprise, for example, a rack and pinion or a jack screw and translating nut driven by an electrical or hydraulic motor. Mounting the handling assembly (e.g., clamp 44) on a movable carriage 52 can allow the core tube handling device 14 to accommodate core tubes of various sizes and can enable the holding device to remove the core tube from the drill string.

Figure 9:
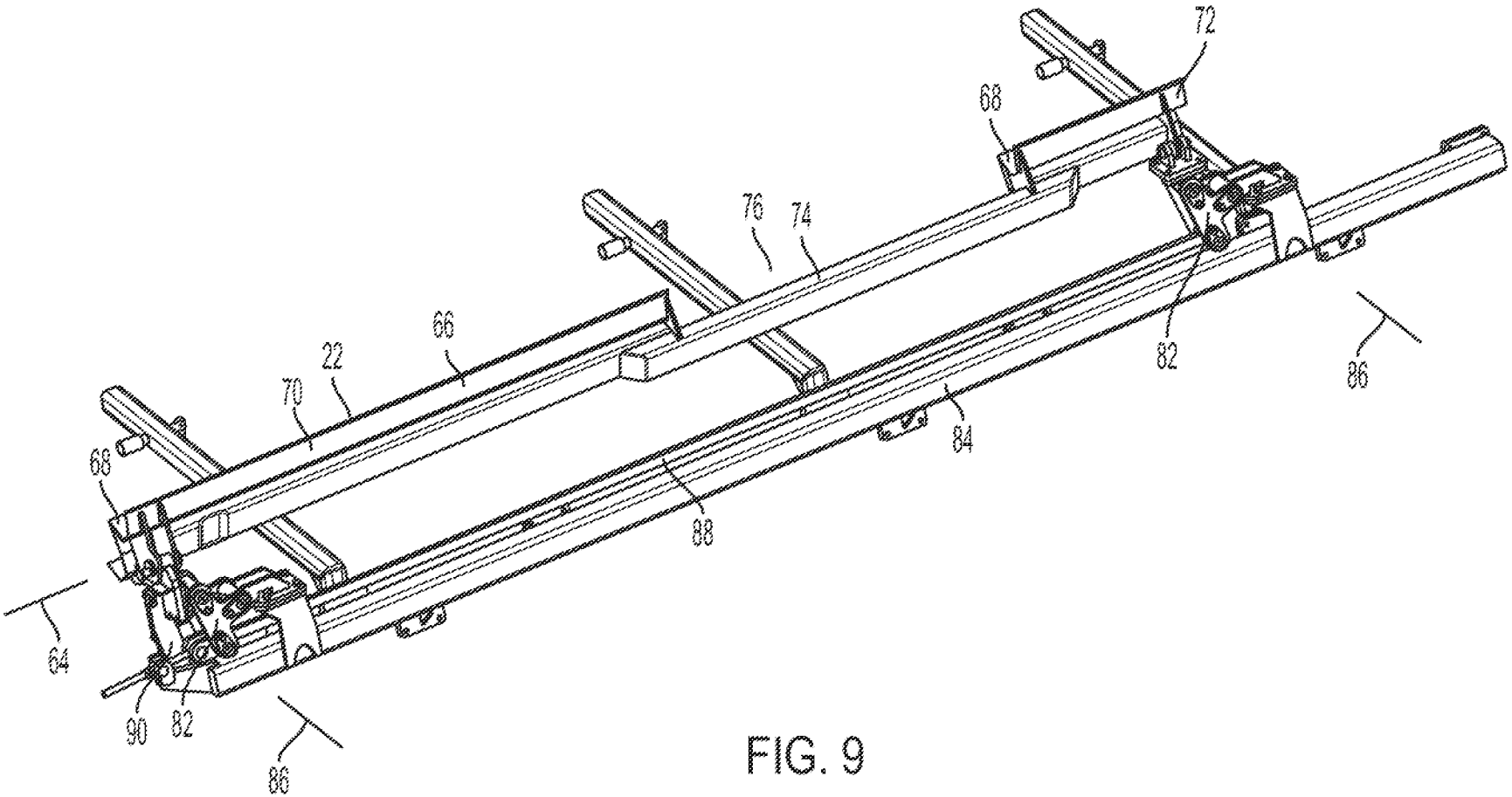
FIGS. 9 and 10 are isometric views of a tray system used with the core tube handling device in accordance with the present disclosure.
Figure 12:
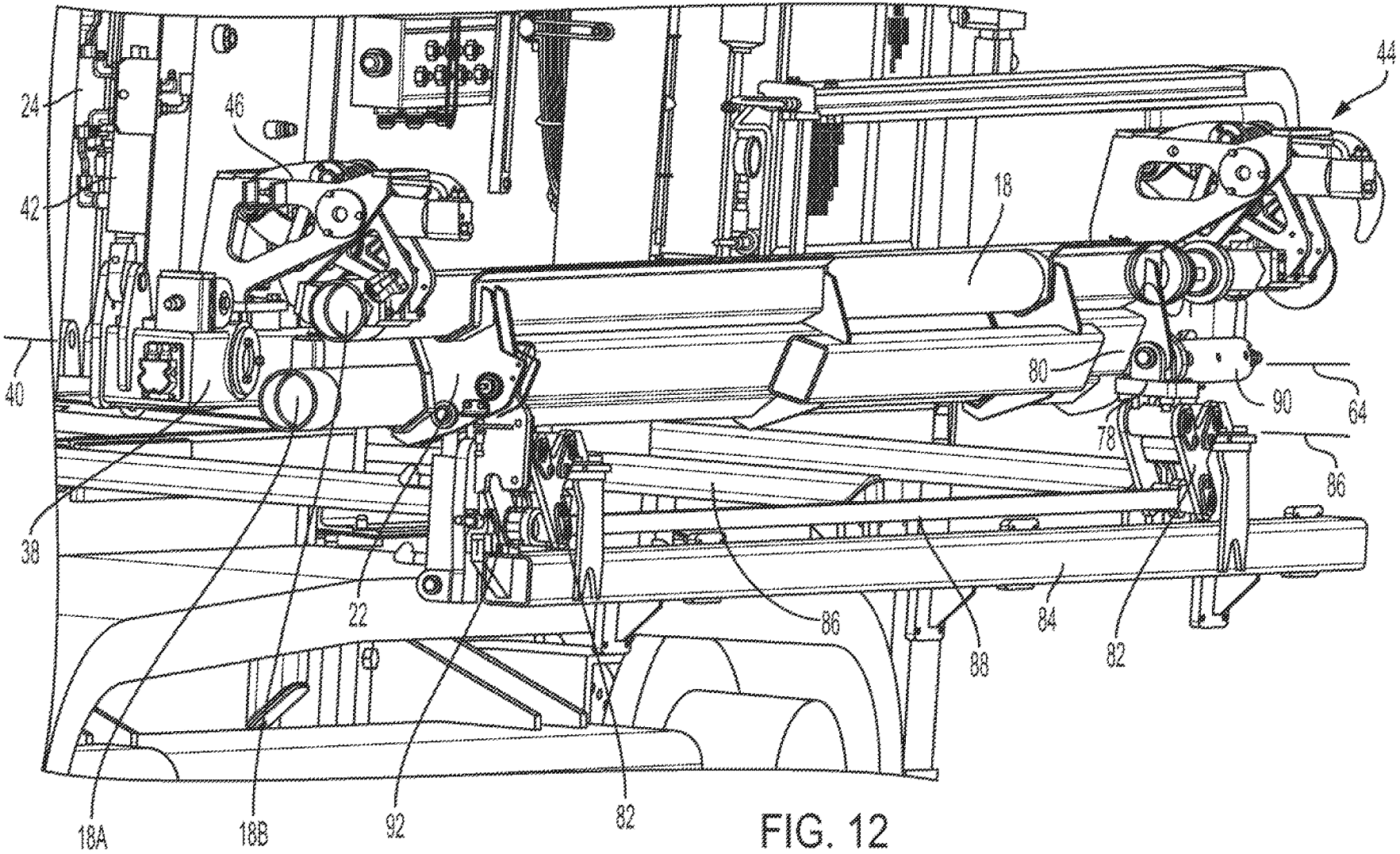
FIGS. 12 and 13 are isometric views of a component used with the core tube handling device in accordance with the present disclosure.

The core tube handling device 14 can further include a tray 22 (see FIGS. 2 and 9). The tray 22 can define a longitudinal axis 64 oriented transversely to the slew arm 24. The tray 22 can receive core tubes 18. As shown in FIGS. 2 and 12, the pivot arm 38 can be aligned with the tray 22 when the slew arm 24 is pivoted away from the mast 12 and the pivot arm 38 is pivoted transversely to the slew arm 24 to permit clamps 44 and 46 to release a core tube 18 to the tray 22. As shown in FIG. 9, tray 22 can comprise a first trough 66 having opposing sidewalls 68 and 70 that are spaced to receive a core tube 18. A second trough 72, also comprising opposing sidewalls 68 and 70 can be aligned with the first trough 66. The first and second troughs 66, 72 can be connected by a link 74 extending between the first and second troughs. The link 74 can be used to define a gap 76 between the troughs 66 and 72 that can accommodate the first clamp 44, if necessary, when a core tube 18 is received within the tray 22. The gap 76 can further enable holding of core tubes having a variety of lengths. As can be seen more clearly in FIG. 12, the tray 22 can be a double tray, having additional first and second troughs 66 and 72 to thereby define a first core tube receptacle 67 and a second core tube receptacle 69. In this way, the tray 22 can receive two core tubes. For example, one core tube 18*a* can be empty, and the other core tube 18*b* can be full. Thus, the core handling device 14 can alternate between core tubes so that the full core tube can be emptied for processing while the core tube handling device 14 inserts the empty core tube for collection of another core sample. Although described herein as comprising two troughs, it is contemplated that three or more troughs (e.g., four troughs) can be used. In further aspects, it is contemplated that individual trays comprising one or more troughs can be coupled together to function in the same manner as a single tray having multiple troughs.

Figure 10:
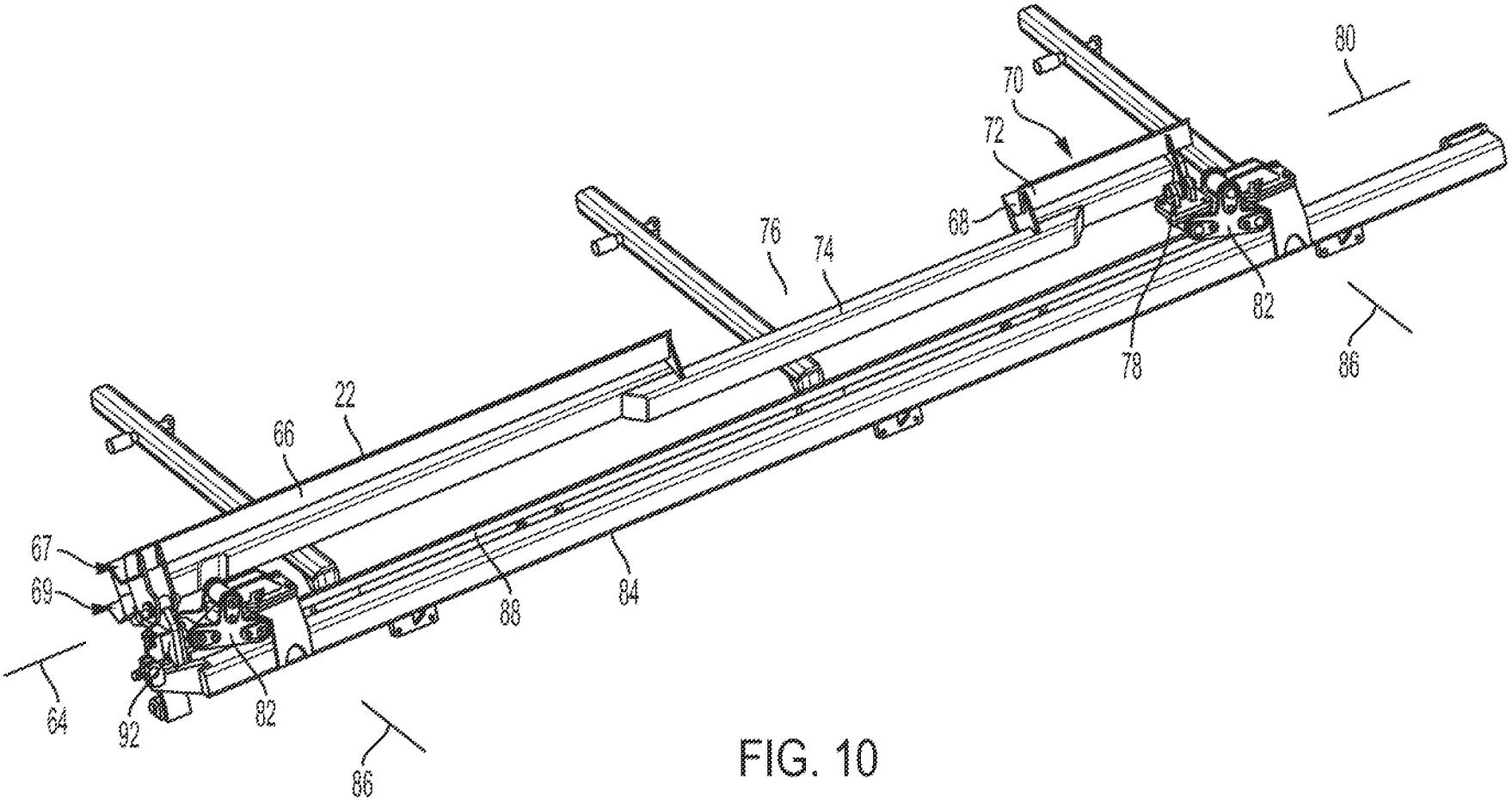

The tray 22 can be rotatable about longitudinal axis 64 as shown in FIGS. 10 and 12. The tray can be mounted on bearings 78 defining axes of rotation 80 that are parallel to, and (optionally) equally spaced from, the longitudinal axis 64. In turn, bearings 78 can be mounted on links 82 attached to a support beam 84 for rotation about axes 86 that are perpendicular to the longitudinal axis 64. Links 82 can be connected by a rod 88, and, together, the links 82, the tray 22 and the rod 88 can form a four bar linkage that can enable the tray to remain parallel to and move toward and away from the support beam 84. Rotation of tray 22 about longitudinal axis 64 can be effected by an actuator 90 that can operate between the support beam 84 and the tray 22. In some embodiments, the actuator 90 can comprise a hydraulic cylinder. Motion of the tray 22 toward and away from the support beam 84 can be effected by an actuator 92. For example, as shown, a threaded nut and jackscrew can push or pull rod 88 to raise or lower the tray 22. Rotation of the threaded nut may be effected by an electrical motor. The different positions of the tray 22 toward and away from the support beam 84 can accommodate different heights of the pivot arm 38 that can vary based on the core tube's diameter or the angle of the mast.

Core tube handling device 14 may also include an overshot tube 94 mounted on the slew arm 24 (see FIG. 2). The overshot tube 94 can provide a convenient place to park an overshot 122 when it is used in the drill string and decoupled from the inner tube assembly.

Figure 11B:
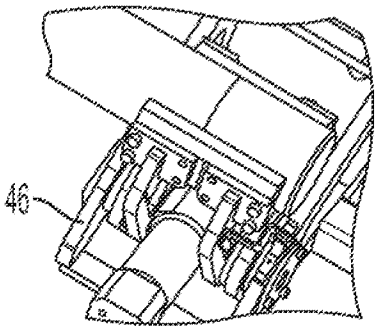
FIG. 11B is a detail view of the clamp of FIG. 11A.
Figure 11A:
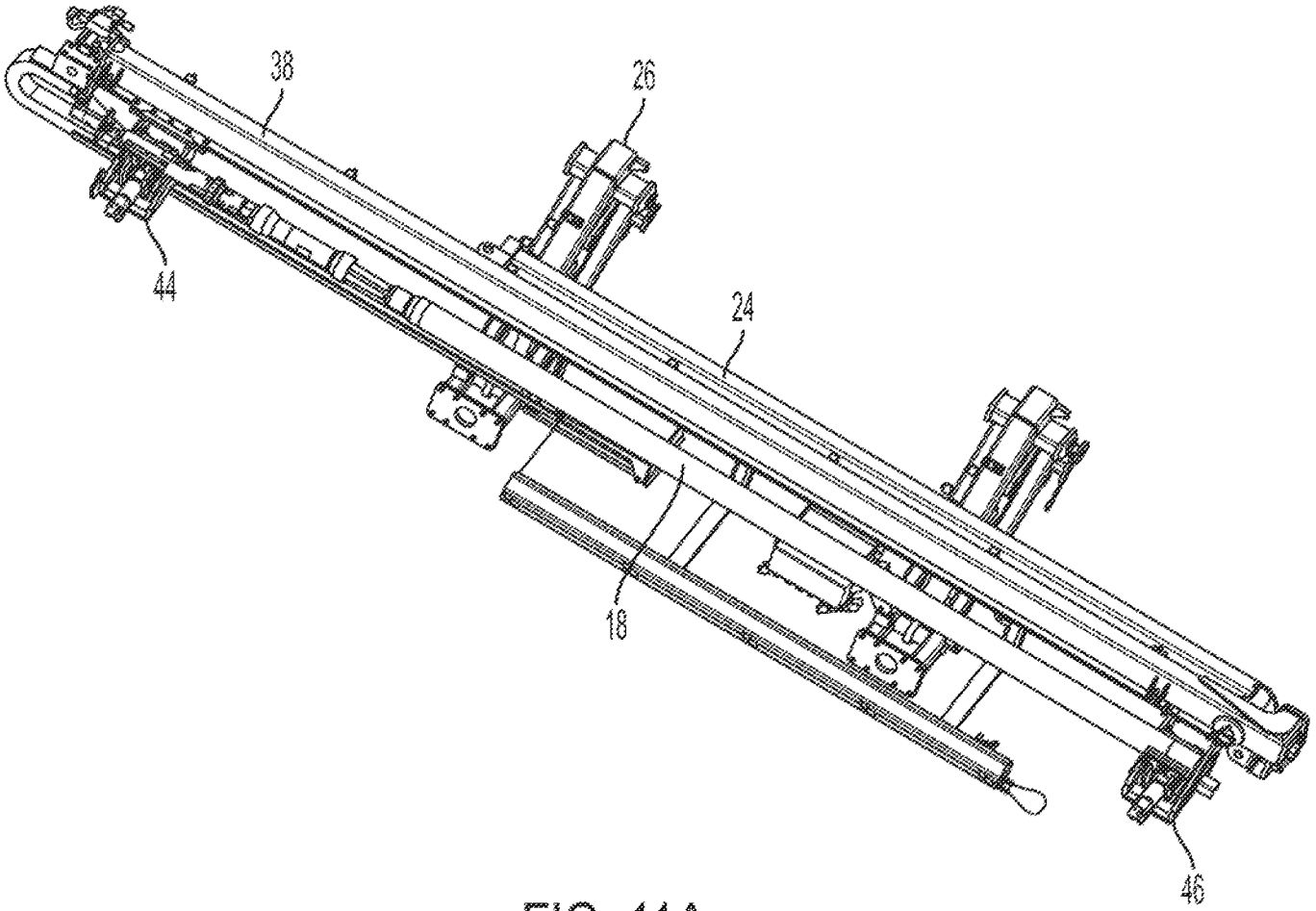
FIG. 11A is an isometric view of the core tube handling device shown in FIG. 5.

Operation of the core tube handling device is described with reference to FIGS. 1, 2, 5, 11, 12 and 13. As shown in FIGS. 1 and 11, the pivot arm 38 can be oriented parallel to the slew arm 24, and the slew arm can be positioned proximate to the mast 12. A core tube 18 that is removed from the drill string 16 can be gripped by the clamp 44. Based on the configuration of the drill rig and associated equipment, an operator optionally elect to decouple the overshot from the spear 97 of the inner tube assembly 95 and park the overshot in the overshot tube 94. In further aspects, the operator can elect to leave the overshot attached to the inner tube assembly.

The core tube handling device can remove the core tube from the drill string 16. In some embodiments, the upper holding device can engage the core tube. For example the upper clamp 44 can grip the core tube (or inner tube assembly). Alternatively, the spear attachment 300 can be attached to the spear 97 of the inner tube, and the clamp 44 or the spear attachment engagement structure can engage the spear attachment 300. The upper holding device can then move vertically along the pivot arm 38 via the carriage 52 to remove the core tube from the drill string.

In further aspects, the core tube handling device can remove the core tube from the drill string via incrementally lifting and re-gripping the core tube. For example, the clamp 44 can move to a lower position (proximate to the second clamp 46) and grip the inner tube assembly. The clamp 44 can move upwardly to lift the inner tube assembly from the drill string 16. The second clamp 46 can then grip the inner tube assembly, and the first clamp 44 can subsequently release the inner tube assembly, move to the lower position, and again grip the inner tube assembly. The second clamp 46 can release the core tube, and the first clamp 44 can move away from the second clamp to further lift the inner tube assembly. The process can repeat until the inner tube assembly is entirely removed from the drill string. Similarly, upper and lower electromagnetic handling assemblies, as disclosed herein, can alternatingly hold the inner tube assembly to remove the inner tube assembly.

Figure 13:
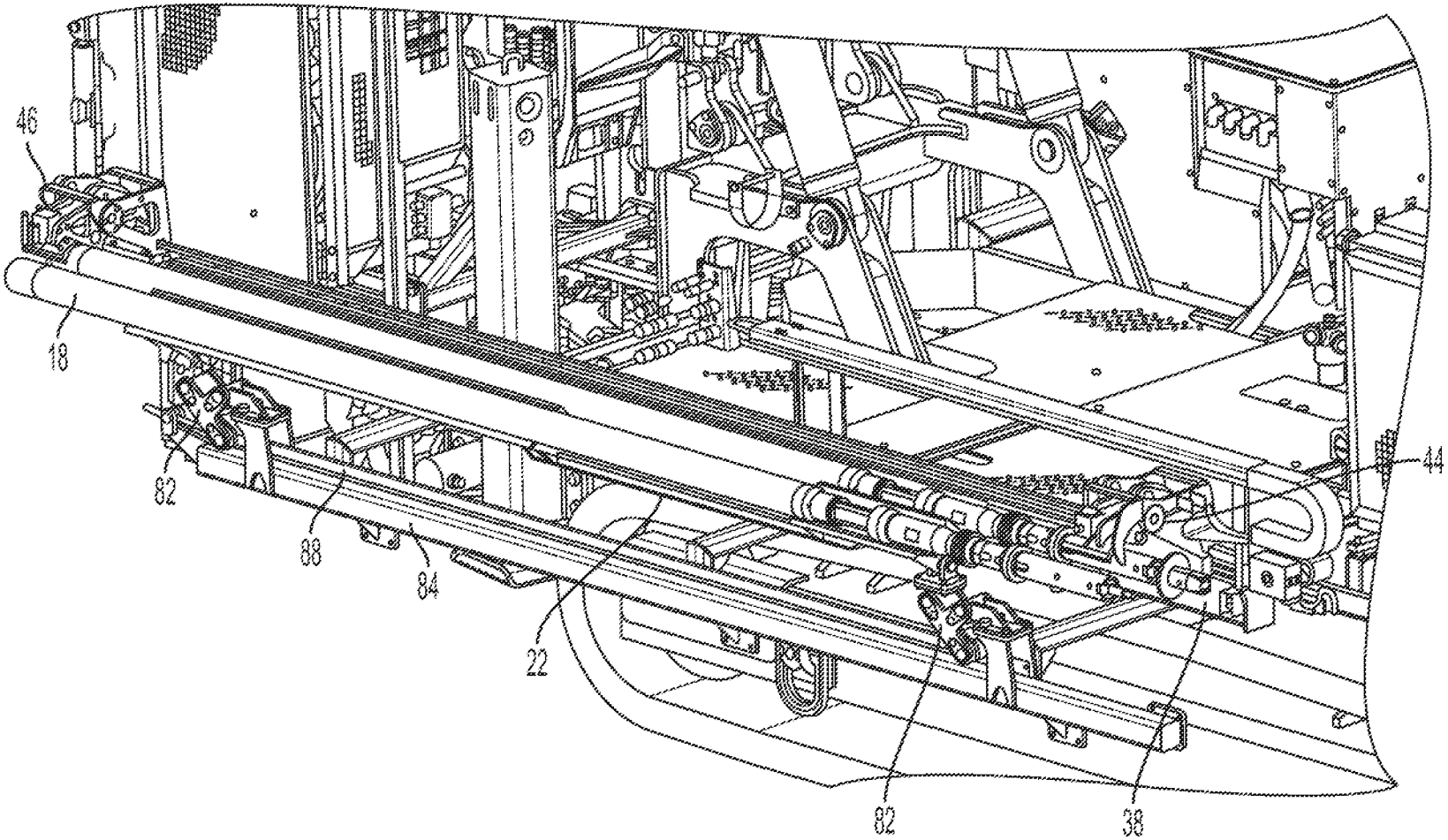

As shown in FIG. 2, with one or both holding devices/clamps 44 holding the core tube, the slew arm 24 can pivot about the first axis 32 to align the pivot arm 38 with the tray 22. If the overshot is still connected to the inner tube assembly, then the wireline cable can controlled as necessary (e.g., letting out slack from the winch) to maintain a select tension. The select tension can prevent the cable on the winch from getting tangled. As shown in FIGS. 5 and 12, the pivot arm 38 can pivot about the second axis 40 to bring the core tube 18 into proximity with the tray 22. If the receptacle 67, 69 below the core tube 18 is not empty (i.e., has another core tube therein), the tray 22 can be rotated about axes 80 (64) to position the alternative receptacle 67, 69 below the core tube. The tray can then be raised away from the support beam 84 to receive the core tube 18 in empty troughs 66 and 72 of the empty receptacle (the first receptacle 67 or the second receptacle 49). The core tube 18 can be released by the clamps 44 and 46, and, as shown in FIG. 13, can be ready to have the core sample removed.

The empty core tube can be loaded into the drill string in a reverse manner. For example, the tray 22 can be pivoted about axes 80 (64) to position the empty core tube below the clamps 44, 46. The tray can be raised away from the support beam 84 (via actuation of the actuator 90) to position the empty core tube so that the clamp(s) (or other holding devices) can receive the empty core tube. The clamps 44, 46 can then grip the empty core tube 18 from the tray 22. The pivot arm 38 can pivot upward to become parallel with the slew arm 24. The slew arm can pivot about the first axis 32 to align the inner tube assembly with the drill string 16. In the reverse manner to that for removing the core tube, the first clamp 44 and second clamp 46 can alternatingly grip the core tube, and the first clamp 44 can move along its axis of translation via the carriage 52 to insert the core tube into the drill string.

If the overshot remains attached to the inner tube assembly during movement of the pivot arm 38, an operator can transfer the overshot from the full core tube to the empty core tube while both core tubes are on the tray. Alternatively, if the overshot is detached from the full core tube and parked in the overshot tube 94, the overshot can be attached to the inner tube assembly of the empty core tube after the handling device 10 has received the empty core tube in the clamps and the pivot arm has pivoted upward to the first (vertical) orientation.

Although not shown, the slew arm, the pivot arm, the clamps, the tray and the carriage and other moving parts can be equipped with sensors which provide feedback as to position, speed and status of the various components. Such sensors can include proximity switches, contact switches and linear and rotary encoders that can generate signals used by a control system, for example, a microprocessor based system such as a programmable logic controller, to allow precise, positive control, and permit full or partial automation of the device.

It can be understood that drilling rigs using the core tube handling device according to the embodiments disclosed herein can operate more efficiently and with greater safety. As can be appreciated by those skilled in the art, the core tube handling device can be implemented with different drill rigs having wireline winches in various locations and with drill rigs having or omitting a sheave roller assembly.

EXEMPLARY ASPECTS

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A device for moving core tubes in a drilling apparatus having a mast supporting a drill string, said device comprising: a slew arm mountable on said mast in an orientation parallel thereto, said slew arm being pivotable toward and away from said mast about a first axis oriented parallel to said mast and offset therefrom; a pivot arm mounted on said slew arm, said pivot arm being movable between a first orientation parallel to said slew arm and a second orientation transverse thereto; a core tube handling assembly mounted on said pivot arm and being movable lengthwise therealong, wherein the core tube handling assembly is configured to receive and lift a core tube.

Aspect 2: The device according to aspect 1, wherein the handling assembly comprises a first clamp having first and second jaws movable toward and away from one another for gripping said core tubes.

Aspect 3: The device according to aspect 1, wherein the core tube handling assembly comprises: a structure defining a receiving space that is configured receive at least a portion of an inner tube assembly that comprises the core tube and a spear; and a spear attachment comprising a receptacle that is configured to releasably receive and couple to the spear of the inner tube assembly, wherein the spear attachment device defines a radially extending flange, wherein the structure of the handling device is configured to engage the radially extending flange of the spear attachment on opposing sides of the receptacle of the spear attachment.

Aspect 4: The handling device according to any one of the preceding aspects, further comprising at least one bracket for attaching said slew arm to said mast, said at least one bracket comprising: a spar attachable to said mast; a swing arm having a first end pivotably attached to said spar, and a second end attached to said slew arm; and an actuator operating between said spar and said swing arm for effecting pivoting motion of said slew arm toward and away from said mast about said first axis.

Aspect 5: The handling device according to aspect 4, wherein said actuator comprises a hydraulic cylinder.

Aspect 6: The handling device according to any one of the preceding aspects, wherein said pivot arm is pivotably attached to said slew arm for pivoting motion about a second axis oriented transversely to both said slew arm and said pivot arm, said handling device further comprising an actuator acting between said pivot arm and said slew arm for effecting pivoting motion of said pivot arm about said second axis.

Aspect 7: The handling device according to aspect 6, wherein said actuator comprises a hydraulic cylinder.

Aspect 8: The handling device according to aspect 2, further comprising: a guide rail mounted on said pivot arm and oriented lengthwise therealong; a carriage mounted on said guide rail and movable therealong, said first clamp being mounted on said carriage; a first actuator mounted on said carriage, said first actuator acting between said first and second jaws for effecting gripping of said core tubes; and a second actuator mounted on said pivot arm for effecting motion of said carriage lengthwise therealong.

Aspect 9: The handling device according to aspect 8, wherein said first actuator comprises a hydraulic cylinder.

Aspect 10: The handling device according to aspect 8, wherein said second actuator is selected from the group consisting of an endless chain arranged lengthwise along said pivot arm and a rack-and-pinion drive.

Aspect 11: The handling device according to aspect 2 or aspect 8, further comprising a second clamp mounted on said pivot arm, said second clamp comprising first and second jaws movable toward and away from one another for gripping said core tubes.

Aspect 12: The handling device according to aspect 11, further comprising an actuator acting between said first and second jaws of said second clamp.

Aspect 13: The handling device according to aspect 12, wherein said actuator comprises a hydraulic cylinder.

Aspect 14: The handling device according to any one of aspects 11-13, wherein said second clamp is fixedly mounted on said pivot arm.

Aspect 15: The handling device according to any one of the preceding aspects, further comprising a tray for receiving said core tubes, said tray defining a longitudinal axis oriented transversely to said slew arm and aligned with said pivot arm when said slew arm is pivoted away from said mast.

Aspect 16: The handling device according to aspect 15, wherein said tray is movable toward and away from said pivot arm to receive said core tube therefrom when said pivot arm is oriented parallel to said tray.

Aspect 17: The handling device according to aspect 16, wherein said tray comprises a bar of a four bar linkage to effect motion of said tray toward and away from said pivot arm.

Aspect 18. The handling device according to any one of aspects 15-17, wherein said tray comprises: a first trough having opposing sidewalls spaced to receive one of said core tubes; a second trough having opposing sidewalls spaced to receive said one core tube, said second trough being aligned with said first trough; a link extending between said first and second troughs, said link defining a gap in said tray for accommodating said first clamp when said one core tube is received in said tray.

Aspect 19: The handling device according to any one of aspects 15-18, wherein said tray comprises a first receptacle and a second receptacle that is parallel to the first receptacle.

Aspect 20: The handling device according to aspect 19, wherein said tray is rotatable about said longitudinal axis to selectively alternate between alignment of the first receptacle of the tray with the pivot arm and alignment of the second receptacle of the tray with the pivot arm.

Aspect 21: The handling device according to any one of the preceding aspects, wherein the pivot arm is configured to be coupled to the slew arm so that the pivot arm is fixed an orientation that is substantially parallel to the slew arm.

Aspect 22: The handling device according to any one of the preceding aspects, further comprising an overshot tube mounted on said slew arm, said overshot tube sized to receive an overshot from said core tube.

Aspect 23: A drilling rig using core tubes in exploration drilling, said drilling rig comprising: a mast; a slew arm mounted on said mast in an orientation parallel thereto, said slew arm being pivotable toward and away from said mast about a first axis oriented parallel to said mast and offset therefrom; a pivot arm mounted on said slew arm, said pivot arm being movable between a first orientation parallel to said slew arm and a second orientation transverse thereto; a core tube handling assembly mounted on said pivot arm and being movable lengthwise therealong, wherein the core tube handling assembly is configured to receive and lift a core tube.

Aspect 24: A method comprising: removing an inner tube assembly from a drill string with a drill rig, the drill rig comprising: a mast; a slew arm mounted on said mast in an orientation parallel thereto, said slew arm being pivotable toward and away from said mast about a first axis oriented parallel to said mast and offset therefrom; a pivot arm mounted on said slew arm, said pivot arm being movable between a first orientation parallel to said slew arm and a second orientation transverse thereto; a core tube handling assembly mounted on said pivot arm and being movable lengthwise therealong, wherein removing the inner tube assembly from the drill string comprises using the core tube handling assembly to receive and lift a core tube of the inner tube assembly.

Aspect 25: The method of aspect 24, wherein the drill rig comprises a wireline assembly comprising an overshot, wherein removing the inner tube assembly comprises maintaining a coupling between the overshot and the inner tube assembly while pivoting the pivot arm with respect to the slew arm.

Aspect 26: The method of aspect 24, wherein the drill rig comprises a wireline assembly comprising an overshot, wherein removing the inner tube assembly comprises decoupling the overshot from the inner tube assembly before pivoting the pivot arm with respect to the slew arm.

Aspect 27: The method of any one of aspects 24-26, wherein the core tube handling assembly comprises a first clamp comprising first and second jaws movable toward and away from one another for gripping said core tubes, wherein the drill rig further comprises: a carriage that is movable along the length of the pivot arm; a first actuator that is configured to effect movement of at least one of said first and second jaws of the first actuator for effecting gripping of said core tubes; and a second actuator mounted on said pivot arm for effecting motion of said carriage lengthwise therealong; a second clamp mounted on said pivot arm, said second clamp comprising first and second jaws movable toward and away from one another for gripping said core tubes, wherein removing the inner tube assembly from the drill string comprises: gripping the inner tube assembly with first clamp, moving the carriage away from the second clamp, gripping the inner tube assembly with the second clamp, releasing the inner tube assembly with the first clamp, moving the carriage toward the second clamp, griping the inner tube assembly with the first clamp, releasing the inner tube assembly with the second clamp, and moving the carriage away from the second clamp.

Although the foregoing invention has been described in some detail by way of illustration and example for purposes of clarity of understanding, certain changes and modifications may be practiced within the scope of the appended claims.

What is claimed is:

1. A device for moving core tubes in a drilling apparatus having a mast supporting a drill string, said device comprising:

a slew arm mountable on said mast in an orientation parallel thereto, said slew arm being pivotable toward and away from said mast about a first axis oriented parallel to said mast and offset therefrom;

a pivot arm mounted on said slew arm, said pivot arm being movable between a first orientation parallel to said slew arm and a second orientation transverse thereto; and a core tube handling assembly mounted on said pivot arm and being movable lengthwise therealong, wherein the core tube handling assembly is configured to receive and lift a core tube from within a drill string.

2. The device according to claim 1, wherein the handling assembly comprises a first clamp having first and second jaws movable toward and away from one another for gripping said core tubes.

3. The device according to claim 2, further comprising:

a guide rail mounted on said pivot arm and oriented lengthwise therealong;

a carriage mounted on said guide rail and movable therealong, said first clamp being mounted on said carriage;

a first actuator mounted on said carriage, said first actuator acting between said first and second jaws for effecting gripping of said core tubes; and a second actuator mounted on said pivot arm for effecting motion of said carriage lengthwise therealong.

4. The device according to claim 3, wherein said first actuator comprises a hydraulic cylinder.

5. The device according to claim 3, wherein said second actuator is selected from the group consisting of an endless chain arranged lengthwise along said pivot arm and a rack-and-pinion drive.

6. The device according to claim 2, further comprising a second clamp mounted on said pivot arm, said second clamp comprising first and second jaws movable toward and away from one another for gripping said core tubes.

7. The device according to claim 6, farther comprising an actuator acting between said first and second jaws of said second clamp.

8. The device according to claim 7, wherein said actuator comprises a hydraulic cylinder.

9. The device according to claim 6, wherein said second clamp is fixedly mounted on said pivot arm.

10. The device according to claim 1, wherein said pivot arm is pivotably attached to said slew arm for pivoting motion about a second axis oriented transversely to both said slew arm and said pivot arm, said device further comprising an actuator acting between said pivot arm and said slew arm for effecting pivoting motion of said pivot arm about said second axis.

11. The device according to claim 10, wherein said actuator comprises a hydraulic cylinder.

12. The device according to claim 1, further comprising a tray for receiving said core tubes, said tray defining a longitudinal axis oriented transversely to said slew arm and aligned with said pivot arm when said slew arm is pivoted away from said mast.

13. The device according to claim 12, wherein said tray is movable toward and away from said pivot arm to receive said core tube therefrom when said pivot arm is oriented parallel to said tray.

14. The device according to claim 13, wherein said tray comprises a bar of a four bar linkage to effect motion of said tray toward and away from said pivot arm.

15. The device according to claim 12, wherein said tray comprises:

a first trough having opposing sidewalls spaced to receive one of said core tubes;

a second trough having opposing sidewalls spaced to receive said one core tube, said second trough being aligned with said first trough;

a link extending between said first and second troughs, said link defining a gap in said tray for accommodating said first clamp when said one core tube is received in said tray.

16. The device according to claim 12, wherein said tray comprises a first receptacle and a second receptacle that is parallel to the first receptacle.

17. The device according to claim 16, wherein said tray is rotatable about said longitudinal axis to selectively alternate between alignment of the first receptacle of the tray with the pivot arm and alignment of the second receptacle of the tray with the pivot arm.

18. The device according to claim 1, further comprising an overshot tube mounted on said slew arm, said overshot tube sized to receive an overshot from said core tube.

19. A device for moving core tubes in a drilling apparatus having a mast supporting a drill string, said device comprising:

a slew arm mountable on said mast in an orientation parallel thereto, said slew arm being pivotable toward and away from said mast about a first axis oriented parallel to said mast and offset therefrom;

at least one bracket for attaching said slew arm to said mast, said at least one bracket comprising:

a spar attachable to said mast;

a swing arm having a first end pivotably attached to said spar, and a second end attached to said slew arm; and an actuator operating between said spar and said swing arm for effecting pivoting motion of said slew arm toward and away from said mast about said first axis;

a pivot arm mounted on said slew arm, said pivot arm being movable between a first orientation parallel to said slew arm and a second orientation transverse thereto; and a core tube handling assembly mounted on said pivot arm and being movable lengthwise therealong, wherein the core tube handling assembly is configured to receive and lift a core tube.

20. The device according to claim 19, wherein said actuator comprises a hydraulic cylinder.

21. A device for moving core tubes in a drilling apparatus having a mast supporting a drill string, said device comprising:

a slew arm mountable on said mast in an orientation parallel thereto, said slew arm being pivotable toward and away from said mast about a first axis oriented parallel to said mast and offset therefrom;

a pivot arm mounted on said slew arm, said pivot arm being movable between a first orientation parallel to said slew arm and a second orientation transverse thereto; and a core tube handling assembly mounted on said pivot arm and being movable lengthwise therealong, wherein the core tube handling assembly is configured to receive and lift a core tube, wherein the pivot arm is configured to be coupled to the slew arm so that the pivot arm is fixed an orientation that is substantially parallel to the slew arm.

22. A drilling rig using core tubes in exploration drilling, said drilling rig comprising:

a mast;

a slew arm mounted on said mast in an orientation parallel thereto, said slew arm being pivotable toward and away from said mast about a first axis oriented parallel to said mast and offset therefrom;

a pivot arm mounted on said slew arm, said pivot arm being movable between a first orientation parallel to said slew arm and a second orientation transverse thereto; and a core tube handling assembly mounted on said pivot arm and being movable lengthwise therealong, wherein the core tube handling assembly is configured to receive and lift a core tube from within a drill string.

23. A method of using the drilling rig of claim 22, the method comprising:

removing an inner tube assembly from within a drill string with the drilling rig, wherein removing the inner tube assembly from the drill string comprises using the core tube handling assembly to receive and lift a core tube of the inner tube assembly.

24. The method according to claim 23, wherein the drill rig comprises a wireline assembly comprising an overshot, wherein removing the inner tube assembly comprises maintaining a coupling between the overshot and the inner tube assembly while pivoting the pivot arm with respect to the slew arm.

25. The method according to claim 24, wherein the drill rig comprises a wireline assembly comprising an overshot, wherein removing the inner tube assembly comprises decoupling the overshot from the inner tube assembly before pivoting the pivot arm with respect to the slew arm.

* * * * *